US008454093B2

(12) United States Patent
Smith

(10) Patent No.: US 8,454,093 B2
(45) Date of Patent: Jun. 4, 2013

(54) MESH CHAIR WITH OPEN-END HOOP

(75) Inventor: Richard D. Smith, Spanish Fork, UT (US)

(73) Assignee: Mity-Lite, Inc., Orem, UT (US)

( * ) Notice: Subject to any disclaimer, the term of this patent is extended or adjusted under 35 U.S.C. 154(b) by 363 days.

(21) Appl. No.: 12/748,823

(22) Filed: Mar. 29, 2010

(65) Prior Publication Data

US 2010/0181807 A1 Jul. 22, 2010

Related U.S. Application Data

(63) Continuation-in-part of application No. 12/612,252, filed on Nov. 4, 2009, now Pat. No. 8,317,269, and a continuation-in-part of application No. 12/612,257, filed on Nov. 4, 2009, now Pat. No. 8,322,787, and a continuation-in-part of application No. 12/422,792, filed on Apr. 13, 2009, now Pat. No. 8,033,598, and a continuation-in-part of application No. 12/422,801, filed on Apr. 13, 2009, now Pat. No. 8,033,612, and a continuation-in-part of application No. 12/422,811, filed on Apr. 13, 2009, now Pat. No. 8,029,059, and a continuation-in-part of application No. 12/422,821, filed on Apr. 13, 2009, now Pat. No. 8,038,221.

(60) Provisional application No. 61/168,837, filed on Apr. 13, 2009, provisional application No. 61/140,756, filed on Dec. 24, 2008.

(51) Int. Cl.
*A47C 7/00* (2006.01)

(52) U.S. Cl.
USPC ..... 297/440.11; 297/55; 297/239; 297/440.2; 297/452.21; 297/447.2

(58) Field of Classification Search
USPC ..... 297/55, 239, 440.11, 440.21, 440.2, 297/452.21, 452.23, 452.33, 452.36, 447.1, 297/447.2
See application file for complete search history.

(56) References Cited

U.S. PATENT DOCUMENTS 30,858 A 12/1860 Pratt
71,045 A 11/1867 Nicolai (Continued)

FOREIGN PATENT DOCUMENTS

DE 3824515 1/1990
DE 4135603 5/1992

(Continued)

OTHER PUBLICATIONS

U.S. Appl. No. 12/612,252, filed Nov. 4, 2009; Richard D. Smith; Office Action issued Feb. 13, 2012.

(Continued)

*Primary Examiner* — David Dunn
*Assistant Examiner* — David E Allred
(74) *Attorney, Agent, or Firm* — Thorpe North & Western LLP

(57) ABSTRACT

A folding or stacking chair has a seat and a backrest carried between opposite frame sides each with a backrest support, a front leg and a rear leg. One or both of the seat and the backrest has a continuous sheet of flexible and elastic knitted mesh or patterned open texture plastic held across and substantially covering an opening in an open-end hoop coupled between the frame sides. An open-end of the hoop faces in a front or a back orientation for the seat, or a top or a bottom orientation for the backrest, with sides of the hoop attached to the frame sides. The sheet of mesh or textured plastic has a finished edge spanning the open-end of the hoop.

18 Claims, 14 Drawing Sheets

U.S. PATENT DOCUMENTS

| | | | | | |
|---|---|---|---|---|---|
| 105,253 | A | | 7/1870 | Rodgers | |
| 116,811 | A | | 7/1871 | Collignon | |
| 128,767 | A | | 7/1872 | Viele | |
| 133,503 | A | | 11/1872 | Travis et al. | |
| 157,028 | A | | 11/1874 | Savoral | |
| 169,748 | A | | 11/1875 | Wakefield | |
| 190,827 | A | | 5/1877 | Closterman, Jr. | |
| 198,421 | A | | 12/1877 | Smith | |
| 210,842 | A | | 12/1878 | Dick | |
| 276,881 | A | | 5/1883 | Roberts | |
| 328,838 | A | | 10/1885 | Chichester | |
| 451,556 | A | | 5/1891 | Hallett | |
| 473,704 | A | | 1/1892 | Le Count | |
| 481,816 | A | | 8/1892 | Perry | |
| 504,446 | A | | 9/1893 | Dodd | |
| 77,327 | A | | 1/1905 | Stiggleman | |
| 779,327 | A | | 1/1905 | Stiggleman | |
| 898,235 | A | | 9/1908 | Lloyd | |
| 931,821 | A | | 8/1909 | Wanner, Jr. | |
| 945,032 | A | | 1/1910 | Gillespie | |
| 976,786 | A | | 11/1910 | Moulin | |
| 1,008,744 | A | | 11/1911 | Smith | |
| 1,181,357 | A | | 5/1916 | Thonet | |
| 1,257,073 | A | | 2/1918 | Frank | |
| 1,291,551 | A | | 1/1919 | Kirk | |
| 1,293,778 | A | | 2/1919 | Holm | |
| 1,355,669 | A | | 10/1920 | Henry | |
| 1,408,114 | A | | 2/1922 | Mathieu | |
| 1,553,226 | A | | 9/1925 | Felts | |
| 1,591,550 | A | | 7/1926 | Rosenthal | |
| 1,595,096 | A | | 8/1926 | Hooker | |
| 1,608,911 | A | | 11/1926 | Smith | |
| D75,556 | S | | 6/1928 | Glantz | |
| 1,701,684 | A | | 2/1929 | Lee | |
| 1,730,916 | A | | 10/1929 | Cable | |
| 1,740,806 | A | | 12/1929 | Clarin | |
| 1,746,952 | A | | 2/1930 | Marwell | |
| 1,756,687 | A | | 4/1930 | Holliday | |
| 1,789,295 | A | | 1/1931 | Bauer | |
| 1,815,643 | A | | 7/1931 | Allerding | |
| 1,825,358 | A | | 9/1931 | Scully | |
| 1,825,368 | A | | 9/1931 | Scully | |
| 1,838,213 | A | | 12/1931 | Buffington | |
| 1,873,768 | A | | 8/1932 | Kux | |
| 1,874,434 | A | | 8/1932 | Brown | |
| 1,900,486 | A | | 3/1933 | Clarin | |
| 1,934,307 | A | | 11/1933 | Hardester | |
| 1,975,622 | A | | 10/1934 | Schermerhorn | |
| 1,989,865 | A | | 2/1935 | Johanson | |
| 1,993,601 | A | | 3/1935 | Goldberg | |
| 2,174,224 | A | | 9/1937 | Geller | |
| 2,098,888 | A | | 11/1937 | Schadler | |
| D107,545 | S | | 12/1937 | O'Connor | |
| 2,126,439 | A | | 8/1938 | Zerbee | |
| 2,127,710 | A | | 8/1938 | Baker | |
| 2,179,516 | A | | 11/1939 | Patrick | |
| 2,186,301 | A | | 1/1940 | La More | |
| 2,220,865 | A | | 11/1940 | Hines | |
| 2,262,500 | A | | 11/1941 | Johannsen | |
| 2,303,189 | A | | 11/1942 | Adler | |
| 2,364,093 | A | | 12/1944 | O'Connor | |
| 2,364,647 | A | | 12/1944 | O'Connor | |
| 2,381,574 | A | | 8/1945 | Clarin | |
| 2,470,113 | A | | 5/1949 | Sebel | |
| 2,483,552 | A | | 10/1949 | Lincoln | |
| 2,514,125 | A | | 7/1950 | Evans | |
| 2,518,971 | A | | 8/1950 | Zillig | |
| 2,568,269 | A | | 9/1951 | Burnham et al. | |
| 2,571,282 | A | | 10/1951 | Newton | |
| 2,666,478 | A | | 1/1954 | Shwayder | |
| 2,671,231 | A | | 3/1954 | Massicotte | |
| 2,694,442 | A | * | 11/1954 | Nordmark | 297/55 |
| 2,699,814 | A | | 1/1955 | Kahm | |
| 2,706,517 | A | | 4/1955 | Dexter et al. | |
| 2,745,181 | A | | 5/1956 | Czerniewicz | |
| D178,900 | S | | 10/1956 | O'Neill | |
| 2,788,531 | A | | 4/1957 | Dye et al. | |
| 2,815,517 | A | | 12/1957 | Anderson | |
| 2,865,437 | A | | 12/1958 | Shwayder | |
| 2,874,755 | A | | 2/1959 | Smith | |
| 2,877,829 | A | | 3/1959 | Ferar et al. | |
| D186,505 | S | | 11/1959 | King et al. | |
| 2,924,830 | A | | 2/1960 | De Long | |
| 2,964,092 | A | | 12/1960 | Rassier | |
| 2,982,339 | A | | 5/1961 | Clarin | |
| 3,001,816 | A | | 9/1961 | Clarin | |
| 3,009,738 | A | | 11/1961 | Piker | |
| 3,021,175 | A | * | 2/1962 | Norquist | 297/58 |
| 3,025,102 | A | | 3/1962 | Nash | |
| 3,031,227 | A | | 4/1962 | Van Buren, Jr. | |
| 3,041,109 | A | * | 6/1962 | Eames et al. | 297/451.4 |
| 3,057,660 | A | | 10/1962 | Hans-Joachim Schneider | |
| 3,059,919 | A | | 10/1962 | Marchino | |
| 3,066,980 | A | | 12/1962 | Clute | |
| 3,087,755 | A | | 4/1963 | Boman | |
| 3,094,357 | A | | 6/1963 | Shwayder | |
| 3,111,344 | A | | 11/1963 | Hoven et al. | |
| 3,123,399 | A | | 3/1964 | Wilson | |
| 3,125,156 | A | | 3/1964 | Grimshaw | |
| 3,133,762 | A | | 5/1964 | Newman | |
| 3,159,425 | A | | 12/1964 | Engstrom | |
| 3,165,359 | A | | 1/1965 | Ashkouti | |
| D200,532 | S | | 3/1965 | Williams | |
| 3,184,768 | A | | 5/1965 | Thomson | |
| D202,264 | S | | 9/1965 | Albinson | |
| 3,205,010 | A | | 9/1965 | Schick | |
| 3,207,551 | A | | 9/1965 | Axtell | |
| 3,220,764 | A | | 11/1965 | Duer | |
| 3,227,487 | A | | 1/1966 | Blanchard, Jr. et al. | |
| 3,233,885 | A | | 2/1966 | Propst | |
| 3,246,927 | A | | 4/1966 | Klassen | |
| 3,246,928 | A | | 4/1966 | Haynes et al. | |
| 3,278,227 | A | | 10/1966 | Rowland | |
| 3,291,523 | A | * | 12/1966 | Krueger | 297/239 |
| 3,291,529 | A | | 12/1966 | Straits | |
| 3,363,943 | A | | 1/1968 | Getz et al. | |
| 3,383,738 | A | | 5/1968 | Fox et al. | |
| 3,402,963 | A | | 9/1968 | Fujioka et al. | |
| 3,419,295 | A | | 12/1968 | Small | |
| 3,463,547 | A | | 8/1969 | Brennan et al. | |
| 3,529,866 | A | | 9/1970 | Getz | |
| 3,531,157 | A | | 9/1970 | Duckett et al. | |
| D219,032 | S | | 10/1970 | Christenson | |
| 3,540,776 | A | | 11/1970 | Wilson | |
| 3,586,277 | A | | 6/1971 | Voris, Jr. | |
| 3,610,686 | A | | 10/1971 | Caruso | |
| 3,614,157 | A | | 10/1971 | Hendrickson | |
| 3,630,572 | A | | 12/1971 | Homler | |
| 3,639,001 | A | | 2/1972 | Anderson | |
| 3,669,496 | A | | 6/1972 | Chisholm | |
| 3,669,497 | A | | 6/1972 | Massonnet | |
| 3,695,687 | A | | 10/1972 | Uyeda | |
| 3,695,694 | A | | 10/1972 | Mohr | |
| 3,695,964 | A | | 10/1972 | Shaines et al. | |
| 3,697,130 | A | | 10/1972 | Barecki et al. | |
| 3,708,202 | A | | 1/1973 | Barecki et al. | |
| 3,712,666 | A | | 1/1973 | Stoll | |
| 3,730,465 | A | | 5/1973 | Gonzalez | |
| 3,754,786 | A | | 8/1973 | Boucher et al. | |
| 3,755,853 | A | | 9/1973 | Barile | |
| 3,758,155 | A | | 9/1973 | Straits | |
| 3,774,967 | A | | 11/1973 | Rowland | |
| 3,802,734 | A | | 4/1974 | Lindley | |
| 3,813,149 | A | | 5/1974 | Lawrence et al. | |
| 3,838,884 | A | | 10/1974 | Faiks et al. | |
| 3,840,269 | A | | 10/1974 | Ambrose | |
| 3,844,517 | A | | 10/1974 | Fraser | |
| 3,845,984 | A | | 11/1974 | Rowland | |
| 3,847,433 | A | | 11/1974 | Acton et al. | |
| 3,889,999 | A | | 6/1975 | Mackintosh | |
| 3,899,207 | A | | 8/1975 | Mueller | |
| 3,904,242 | A | | 9/1975 | Koepke et al. | |
| 3,906,592 | A | | 9/1975 | Sakasegawa et al. | |
| 3,924,893 | A | | 12/1975 | Ferrara | |
| 3,939,565 | A | | 2/1976 | Bush | |
| 3,958,289 | A | | 5/1976 | Carlson | |
| 3,982,785 | A | | 9/1976 | Ambasz | |

3,994,529 A 11/1976 Lippert
4,057,288 A * 11/1977 Schwartz et al. ..... 297/239
4,062,589 A 12/1977 Klein et al.
4,064,815 A 12/1977 Baum
4,066,295 A 1/1978 Severson
D249,417 S 9/1978 Ambasz
4,114,949 A 9/1978 Benoit
4,155,592 A 5/1979 Tsuda et al.
4,235,473 A 11/1980 Aginar
4,278,287 A 7/1981 Homestead
4,291,855 A 9/1981 Schenkel et al.
4,304,436 A 12/1981 Rowland
4,318,570 A 3/1982 Adam et al.
4,319,779 A 3/1982 Leonhart
4,325,577 A 4/1982 Thebaud
4,357,894 A 11/1982 Kirk
4,359,809 A 11/1982 Fraser
4,368,917 A 1/1983 Urai
4,380,208 A 4/1983 Goserud
4,382,453 A 5/1983 Bujan et al.
4,383,486 A 5/1983 Reineman et al.
4,386,804 A 6/1983 Ware et al.
4,400,031 A 8/1983 DeDecker
4,407,479 A 10/1983 Combe
4,451,085 A 5/1984 Franck et al.
4,456,296 A 6/1984 Rowland
D275,533 S 9/1984 Lantz
4,498,702 A 2/1985 Raftery
4,502,731 A 3/1985 Snider
4,510,634 A 4/1985 Diedrich et al.
4,533,174 A 8/1985 Fleishman
4,536,102 A 8/1985 Doyle
4,541,150 A 9/1985 Brokmann
4,549,764 A 10/1985 Haedo
4,557,521 A 12/1985 Lange
4,558,904 A 12/1985 Schultz
4,561,622 A 12/1985 Heinzel
4,564,163 A 1/1986 Barnett
4,569,496 A 2/1986 Fleishman
4,580,836 A 4/1986 Verney
4,583,778 A 4/1986 Liebhold
4,585,272 A 4/1986 Ballarini
4,601,516 A 7/1986 Klein
4,603,904 A 8/1986 Tolleson et al.
4,603,907 A 8/1986 Witzke
4,613,185 A * 9/1986 Marchesini ..... 297/39
4,617,869 A 10/1986 Denomey
4,624,432 A 11/1986 Salacuse
4,630,865 A 12/1986 Ahs
4,639,042 A 1/1987 Lange
4,648,653 A 3/1987 Rowland
4,655,504 A 4/1987 Weber
4,660,887 A 4/1987 Fleming et al.
D290,070 S 6/1987 Lange
4,684,172 A 8/1987 Lundquist
4,747,569 A 5/1988 Hoshino
4,756,575 A 7/1988 Dicks
4,768,459 A 9/1988 Cerkvenik et al.
4,790,595 A 12/1988 Hensel et al.
D300,885 S 5/1989 Ochsner
4,830,250 A 5/1989 Newbold et al.
4,837,878 A 6/1989 Huemer
4,843,999 A 7/1989 Kobus et al.
4,848,843 A 7/1989 Gibbs
4,852,944 A 8/1989 Hartmann
4,869,552 A 9/1989 Tolleson et al.
4,881,705 A 11/1989 Kraus
4,883,320 A 11/1989 Izumida et al.
4,900,183 A 2/1990 Souchko
4,913,493 A 4/1990 Heidmann
4,923,158 A 5/1990 Saisho
4,953,913 A 9/1990 Graebe
4,962,964 A 10/1990 Snodgrass
4,978,168 A 12/1990 Piretti
5,002,337 A 3/1991 Engel et al.
5,013,089 A 5/1991 Abu-Isa et al.
5,020,749 A 6/1991 Kraus
5,039,163 A 8/1991 Tolleson
5,040,848 A 8/1991 Irie et al.
5,056,699 A 10/1991 Newbold et al.
5,062,179 A 11/1991 Huang
5,064,247 A 11/1991 Clark et al.
5,071,191 A 12/1991 Leib
5,096,259 A 3/1992 Stanfiled
5,101,753 A 4/1992 Hull et al.
5,108,149 A 4/1992 Ambasz
5,110,186 A 5/1992 Clark et al.
5,113,717 A 5/1992 Plamper
5,123,702 A 6/1992 Caruso
5,131,607 A 7/1992 Arnold et al.
5,146,656 A 9/1992 Huang
5,154,485 A 10/1992 Fleishman
5,168,825 A 12/1992 Ring
5,183,314 A 2/1993 Lorbiecki
5,211,323 A 5/1993 Chimenti et al.
5,213,004 A 5/1993 Hoblingre
D337,444 S 7/1993 Lamalle
5,234,185 A 8/1993 Hoffman et al.
5,265,969 A 11/1993 Chuang
5,277,387 A 1/1994 Lewis et al.
5,282,669 A 2/1994 Barile
5,297,851 A 3/1994 Van Hekken
5,323,713 A 6/1994 Luyk et al.
5,356,204 A 10/1994 McDonough
5,367,815 A 11/1994 Liou
5,375,914 A 12/1994 Donnelly
5,382,080 A 1/1995 Gamberini et al.
5,383,712 A 1/1995 Perry
5,393,126 A 2/1995 Boulva
D357,365 S 4/1995 Ward et al.
5,413,015 A 5/1995 Zentmyer
5,427,469 A 6/1995 Glarnyk
5,495,968 A 3/1996 Miller
5,497,537 A 3/1996 Robinson et al.
5,498,098 A 3/1996 Cairns
5,499,883 A 3/1996 Heinzel
5,503,455 A 4/1996 Yang
5,513,899 A 5/1996 Michaels et al.
5,516,193 A 5/1996 Simpson
5,520,474 A 5/1996 Liu
5,524,963 A 6/1996 Barile
5,524,966 A 6/1996 Piretti
5,542,159 A 8/1996 Schultz et al.
5,549,358 A 8/1996 Muller
5,560,678 A 10/1996 Eppelt
5,580,130 A 12/1996 Williams et al.
5,611,598 A 3/1997 Knoblock
5,662,383 A 9/1997 Hand
5,671,975 A 9/1997 Muller
5,681,093 A 10/1997 Pfister
5,692,450 A 12/1997 Alter et al.
5,701,971 A 12/1997 Rchid
5,738,408 A 4/1998 Wu
5,747,140 A 5/1998 Heerklotz
5,762,403 A 6/1998 Robinson
5,775,642 A 7/1998 Beroth
5,779,317 A 7/1998 Neal
5,785,287 A 7/1998 Hoshino
5,820,221 A 10/1998 Greaves et al.
5,825,095 A 10/1998 Albecker, III
5,826,312 A 10/1998 Schroder et al.
5,842,739 A 12/1998 Noble
5,845,589 A 12/1998 Pfister
5,845,970 A 12/1998 Schwartz
5,860,697 A 1/1999 Fewchuk
5,860,700 A 1/1999 Lance
5,863,096 A 1/1999 Bartlmae
5,868,096 A 2/1999 Elvestad
5,871,258 A 2/1999 Battey et al.
D406,195 S 3/1999 Gamberini
5,887,946 A 3/1999 Raftery
5,902,012 A 5/1999 Han
5,904,397 A 5/1999 Fismen
5,934,758 A 8/1999 Ritch et al.
5,947,562 A 9/1999 Christofferson et al.
5,954,391 A 9/1999 Gray
5,961,184 A 10/1999 Balderi et al.
5,964,443 A 10/1999 Leveille 5,967,605 A 10/1999 Stanfiled
5,975,626 A 11/1999 Aycock
5,975,634 A 11/1999 Knoblock et al.
5,988,746 A 11/1999 Raftery
5,988,757 A 11/1999 Vishey et al.
5,997,084 A 12/1999 Barile et al.
6,003,948 A 12/1999 Holbrook
D418,322 S 1/2000 Hock
6,012,679 A 1/2000 Auestad
6,030,037 A 2/2000 Ritch et al.
6,035,901 A 3/2000 Stumpf et al.
6,050,646 A 4/2000 Stenzel et al.
D425,717 S 5/2000 Tseng
6,056,354 A 5/2000 Tseng
6,059,368 A 5/2000 Stumpf et al.
6,065,803 A 5/2000 Li et al.
6,070,940 A 6/2000 Wu
6,079,349 A 6/2000 Simpson
6,095,597 A 8/2000 Huang
6,099,073 A 8/2000 Bruschi
6,102,482 A 8/2000 Dettoni et al.
6,106,061 A 8/2000 Caruso et al.
6,113,186 A 9/2000 Holmes et al.
6,116,692 A 9/2000 Tarnay et al.
6,116,694 A 9/2000 Bullard
D431,400 S 10/2000 Grove
D432,805 S 10/2000 Smith
6,125,521 A 10/2000 Stumpf et al.
6,135,562 A 10/2000 Infanti
D435,977 S 1/2001 Ambasz
D436,457 S 1/2001 Ambasz
D437,501 S 2/2001 Rehmert et al.
6,203,108 B1 3/2001 Mattison, Jr.
6,206,469 B1 3/2001 Caruso et al.
D440,784 S 4/2001 Ambasz
6,234,571 B1 5/2001 Atkins et al.
6,234,578 B1 5/2001 Barton et al.
6,254,190 B1 7/2001 Gregory
D446,661 S 8/2001 Ambasz
6,279,991 B1 8/2001 Atkins et al.
6,279,998 B1 8/2001 Chu et al.
6,305,742 B1 10/2001 Spendlove et al.
6,305,750 B1 10/2001 Buono et al.
D452,619 S 1/2002 Piretti
6,338,587 B1 1/2002 Kuo
6,345,863 B1 2/2002 Laws et al.
6,349,992 B1 2/2002 Knoblock et al.
6,378,944 B1 4/2002 Weisser
6,382,728 B1 5/2002 Buono
6,386,627 B1 5/2002 Tsai
6,386,634 B1 5/2002 Stumpf et al.
6,406,096 B1 6/2002 Barile, Sr.
6,409,268 B1 6/2002 Cvek
D460,300 S 7/2002 Fifield et al.
6,412,869 B1 7/2002 Pearce
6,422,645 B1 7/2002 Smith et al.
6,439,665 B1 8/2002 Cvek
6,450,569 B1 * 9/2002 Liu ..... 297/39
6,471,287 B1 10/2002 Liu
6,471,293 B2 10/2002 Ware et al.
D465,938 S 11/2002 Huang
D465,940 S 11/2002 Nien
6,481,789 B1 11/2002 Amasz
D466,712 S 12/2002 Haney et al.
6,502,902 B1 1/2003 Romero
D469,969 S 2/2003 Glass et al.
D469,971 S 2/2003 Piretti
6,517,151 B2 2/2003 Liu
6,523,898 B1 2/2003 Ball et al.
6,533,352 B1 3/2003 Glass et al.
6,536,079 B2 3/2003 Hill
D473,727 S 4/2003 Tsai
6,543,842 B2 4/2003 Haney
6,547,321 B2 4/2003 Wu
6,550,866 B1 4/2003 Su
6,561,580 B1 5/2003 Bergey
D476,162 S 6/2003 Finazzi
6,582,020 B1 6/2003 Tenenboym et al.
D477,470 S 7/2003 Haney et al.
6,585,323 B2 7/2003 Gaylord et al.
6,588,842 B2 7/2003 Stumpf et al.
6,598,544 B2 7/2003 Laws et al.
6,604,784 B1 8/2003 Bosman et al.
6,612,654 B2 9/2003 Laws et al.
D481,879 S 11/2003 Su
6,644,749 B2 11/2003 VanDeRiet et al.
6,666,518 B2 12/2003 Bruschi et al.
6,669,281 B1 12/2003 Huang
6,688,698 B1 2/2004 Chou et al.
6,702,390 B2 3/2004 Stumpf et al.
6,709,050 B2 3/2004 Huang
6,722,741 B2 4/2004 Stumpf et al.
6,722,742 B2 4/2004 Potes et al.
6,726,285 B2 4/2004 Caruso et al.
6,726,286 B2 4/2004 Stumpf et al.
6,729,691 B2 * 5/2004 Koepke et al. ..... 297/452.56
6,733,080 B2 * 5/2004 Stumpf et al. ..... 297/411.36
6,742,839 B2 6/2004 Piretti
6,755,468 B1 6/2004 Pan
D494,792 S 8/2004 Schmitz et al.
6,779,846 B2 8/2004 Spendlove et al.
D495,509 S 9/2004 Breen
D495,891 S 9/2004 Ambasz
6,837,546 B2 1/2005 VanDeRiet et al.
D501,613 S 2/2005 Kaltenmark et al.
D503,291 S 3/2005 Lucci et al.
6,860,561 B2 * 3/2005 Takata ..... 297/378.1
6,863,341 B1 3/2005 Wen
6,866,338 B2 3/2005 Mendenhall et al.
6,871,906 B2 3/2005 Haney
6,886,890 B2 5/2005 Rowland et al.
6,890,026 B1 5/2005 Shin
6,899,053 B2 5/2005 Hawkins
6,899,396 B2 5/2005 Bales
D505,800 S 6/2005 Lucci et al.
D506,325 S 6/2005 Farber et al.
6,908,159 B2 6/2005 Prince et al.
D507,425 S 7/2005 Ashby et al.
6,923,139 B1 8/2005 Robichaux et al.
6,923,505 B2 8/2005 Siminovitch et al.
6,925,955 B1 8/2005 Brooks
6,935,698 B1 8/2005 Chen
6,942,300 B2 9/2005 Numa et al.
6,957,861 B1 10/2005 Chou et al.
6,966,606 B2 11/2005 Coffield
D513,456 S 1/2006 Smith
6,983,997 B2 1/2006 Wilkerson et al.
6,988,774 B1 1/2006 Elzenbeck
7,004,100 B1 2/2006 Rard et al.
7,021,705 B1 * 4/2006 Niermeyer et al. ..... 297/55
7,021,712 B2 4/2006 Spendlove et al.
7,029,064 B2 4/2006 Chen
D523,254 S 6/2006 Nye et al.
7,059,670 B2 6/2006 Mills et al.
7,066,536 B2 6/2006 Williams et al.
7,066,550 B1 6/2006 Su
7,073,864 B2 7/2006 Olsen
D526,136 S 8/2006 Kettler et al.
D526,138 S 8/2006 Rech
7,104,604 B1 9/2006 Kang
7,107,915 B2 9/2006 Laws et al.
7,111,906 B2 9/2006 Heisey et al.
D532,986 S 12/2006 Kettler et al.
D533,000 S 12/2006 Lu et al.
7,147,286 B2 12/2006 Cesaroni et al.
7,152,929 B2 12/2006 Wu
7,156,459 B2 1/2007 Ambasz
7,165,812 B2 1/2007 Collins
D539,557 S 4/2007 Doughty
D541,068 S 4/2007 Foster
D544,225 S 6/2007 Cantarutti
D544,235 S 6/2007 Chen
7,249,802 B2 7/2007 Schmitz et al.
7,303,230 B2 12/2007 Munn et al.
7,303,235 B1 12/2007 Fongers
D558,999 S 1/2008 Cantarutti
7,338,116 B1 * 3/2008 Lin et al. ..... 297/46
D567,524 S 4/2008 Marin

| | | | | |
|---|---|---|---|---|
| D569,121 | S | 5/2008 | Rizzi | |
| 7,396,076 | B1 | 7/2008 | Hock | |
| 7,396,078 | B2 | 7/2008 | Weber et al. | |
| 7,406,733 | B2 | 8/2008 | Coffield et al. | |
| D580,673 | S | 11/2008 | Wright et al. | |
| D581,708 | S | 12/2008 | Su | |
| 7,458,918 | B1 | 12/2008 | Clark | |
| 7,472,962 | B2 | 1/2009 | Caruso et al. | |
| 7,513,567 | B2 | 4/2009 | Huang | |
| D594,669 | S | 6/2009 | Asano | |
| 7,540,248 | B2 | 6/2009 | London | |
| 7,552,968 | B2 | 6/2009 | Smith et al. | |
| D599,127 | S | 9/2009 | Smith | |
| D600,936 | S | 9/2009 | Koh | |
| 7,631,934 | B2 | 12/2009 | MacIsaac | |
| 7,716,797 | B2 | 5/2010 | Kismarton et al. | |
| 7,717,511 | B2 | 5/2010 | Huang | |
| 7,717,519 | B2 | 5/2010 | Kismarton et al. | |
| 7,735,911 | B2 | 6/2010 | Chen | |
| 7,758,112 | B2 | 7/2010 | Huang | |
| 7,810,882 | B2 | 10/2010 | Bartlmae | |
| 7,896,431 | B2 | 3/2011 | Cui et al. | |
| 7,988,228 | B2 | 8/2011 | Cui et al. | |
| 2001/0028188 | A1 | 10/2001 | Stumpf et al. | |
| 2001/0030457 | A1* | 10/2001 | Gregory | 297/440.11 |
| 2001/0033100 | A1 | 10/2001 | Haney | |
| 2002/0053822 | A1 | 5/2002 | Ware et al. | |
| 2002/0109380 | A1 | 8/2002 | VanDeRiet et al. | |
| 2002/0117883 | A1 | 8/2002 | Gevaert | |
| 2002/0145326 | A1* | 10/2002 | Liu | 297/440.11 |
| 2002/0195863 | A1 | 12/2002 | Su | |
| 2003/0071505 | A1 | 4/2003 | Ferrell | |
| 2003/0071509 | A1* | 4/2003 | Neil et al. | 297/440.11 |
| 2003/0090137 | A1 | 5/2003 | Piretti | |
| 2003/0108385 | A1 | 6/2003 | Finco et al. | |
| 2003/0127887 | A1 | 7/2003 | Laws et al. | |
| 2003/0168894 | A1 | 9/2003 | Lin | |
| 2003/0218372 | A1 | 11/2003 | Balliu Falgueras | |
| 2003/0234563 | A1 | 12/2003 | Huang | |
| 2004/0076465 | A1 | 4/2004 | Geiger | |
| 2004/0245842 | A1 | 12/2004 | Nardi | |
| 2004/0262975 | A1 | 12/2004 | Su | |
| 2005/0001464 | A1 | 1/2005 | Caruso et al. | |
| 2005/0012369 | A1* | 1/2005 | Mendenhall et al. | 297/239 |
| 2005/0077773 | A1 | 4/2005 | Chen | |
| 2005/0146193 | A1 | 7/2005 | Shieh | |
| 2005/0175403 | A1 | 8/2005 | Herb et al. | |
| 2005/0206210 | A1 | 9/2005 | Coffield | |
| 2005/0264087 | A1* | 12/2005 | Diffrient | 297/452.64 |
| 2006/0006715 | A1 | 1/2006 | Chadwick et al. | |
| 2006/0022499 | A1 | 2/2006 | Jones | |
| 2006/0091715 | A1 | 5/2006 | Schmitz et al. | |
| 2006/0138849 | A1* | 6/2006 | Wilkerson et al. | 297/452.56 |
| 2006/0163934 | A1* | 7/2006 | Chen | 297/440.11 |
| 2006/0284469 | A1 | 12/2006 | Lowsky | |
| 2007/0000112 | A1 | 1/2007 | Johnson et al. | |
| 2007/0132291 | A1 | 6/2007 | Smith et al. | |
| 2007/0132302 | A1 | 6/2007 | Smith et al. | |
| 2007/0222266 | A1 | 9/2007 | Lucci et al. | |
| 2008/0277982 | A1 | 11/2008 | Bartlmae | |
| 2008/0315645 | A1 | 12/2008 | Hock | |
| 2008/0315646 | A1 | 12/2008 | Hock | |
| 2009/0038529 | A1 | 2/2009 | Walton et al. | |
| 2009/0079235 | A1 | 3/2009 | Huang | |
| 2009/0146467 | A1* | 6/2009 | Waite et al. | 297/55 |
| 2009/0184548 | A1 | 7/2009 | Vickers et al. | |
| 2009/0236895 | A1 | 9/2009 | Bottemiller | |
| 2010/0176633 | A1 | 7/2010 | Brnick et al. | |
| 2010/0194160 | A1 | 8/2010 | Machael et al. | |
| 2010/0237582 | A1 | 9/2010 | Belenkov et al. | |
| 2011/0025104 | A1 | 2/2011 | Fusao et al. | |
| 2011/0133531 | A1 | 6/2011 | Yeh | |
| 2011/0175412 | A1 | 7/2011 | Piretti | |
| 2011/0187169 | A1 | 8/2011 | Stewart et al. | |

FOREIGN PATENT DOCUMENTS

| | | |
|---|---|---|
| EP | 210710 | 2/1987 |
| EP | 1192879 | 4/2002 |
| JP | 63192691 | 8/1988 |
| JP | 06269330 | 9/1994 |
| WO | WO 2004/037046 | 5/2004 |

OTHER PUBLICATIONS

U.S. Appl. No. 13/245,339, filed Sep. 26, 2011; Richard D. Smith; Office Action issued Jan. 19, 2012.
U.S. Appl. No. 12,612,257, filed Jan. 4, 2009; Richard D. Smith; Office Action issued Feb. 13, 2012.
U.S. Appl. No. 29/379,237, filed Nov. 16, 2010; Richard D. Smith; Notice of Allowance issued Feb. 24, 2012.
Smith, Richard et al., U.S. Appl. No. 29/335,295, filed Apr. 13, 2009.
Smith, Richard et al., U.S. Appl. No. 29/346,705, filed Nov. 4, 2009.
Smith, Richard et al., U.S. Appl. No. 12/612,257, filed Nov. 4, 2009.
Smith, Richard et al., U.S. Appl. No. 12/422,792, filed Apr. 13, 2009.
http://sstores.advancesinteriordesings.com/-strse-972/Mesh-Folding-Chair,-Suave/Detail.bok, Advances Interior Designs—Modern HOme and Office FUrniture, accessed Oct. 2009, 1 page.
DuraMesh Folding Chair, KI A versatile folding chair with a comfortable, durable mesh seat, www.ki.com, accessed Oct. 2009, 2 pages.
Smith, Richard et al., U.S. Appl. No. 12/755,995, filed Apr. 7, 2010.
Smith, Richard et al., U.S. Appl. No. 12/755,954, filed Apr. 7, 2010.
Smith, Richard et al., U.S. Appl. No. 12/757,218, filed Apr. 9, 2010.
Smith, Richard et al., U.S. Appl. No. 12/612,252, filed Nov. 4, 2009.
Herman Miller for business—Mirra Chairs, www.hermanmiller.com/CDA/SSA/Product?0,,a10-c440-p205,00.html, accessed Apr. 8, 2009, 3 pages.
Home Alexander Folding Rockers Set of 2: Target, www.target.com/Home-Alexander-Folding-Rockers-Set/dp/B001CS96AY/qid=1233 . . . accessed Jan. 29, 2009, 4 pages.
Ergo Mesh Folding Guest Chair (Set of 2) from Overstock.com, www.overstock.com/Office-Furniture/Ergo-Mesh-Folding-Guest-Chair-Set of 2/308 . . . , accessed Jan. 29, 2009 3 pages.
Mesh folding chair, mesh chairs, custom chairs, folding camp chairs, custom foldin . . . , www.staplespromotionalproducts.com/ProductDetail.aaspx?id=358, accessed Jan. 29, 2009, 1 page.
Home wrought iron fold chair—set of 4: Target, www.target.com/Home-Wrought-Iron-Fold-Chari/dp/B001IZS8WS/qid=123326645 . . , accessed Jan. 29, 2009 2 pages.
Herman Miller—for buisness-aeron chairs, www.hermanmiller.com/CDA/SSA/Product/1,1592,a10-c440-p8,00.html, accessed Jan. 29, 2009, 4 pages.
Aeron chairs, Herman Miller aeron chair, aeron loaded chairs & aeron chair accesso . . . , www.hermanmillerseating.com/aeron%AE-C79906.html?refid=G2772.%22herman . . . accessed Jan. 29, 2009, 4 pages.
Smith, Richard et al., U.S. Appl. No. 12/422,801, filed Apr. 13, 2009.
Smith, Richard et al., U.S. Appl. No. 12/422,811, filed Apr. 13, 2009.
Smith, Richard et al., U.S. Appl. No. 12/422,821, filed Apr. 13, 2009.
U.S. Appl. No. 12/422,811, filed Apr. 13, 2009; Richard D. Smith; Notice of Allowance issued Jun. 29, 2011.
U.S. Appl. No. 12/422,821, filed Apr. 13, 2009; Richard D. Smith; Notice of Allowance issued Jul. 7, 2011.
U.S. Appl. No. 12/422,801, filed Apr. 13, 2009; Richard D. Smith; Notice of Allowance issued Jul. 13, 2011.
U.S. Appl. No. 12/422,792, filed Apr. 13, 2009; Richard D. Smith; Notice of Allowance issued Jul. 17, 2011.
U.S. Appl. No. 29/346,705, filed Nov. 4, 2009; Richard D. Smith; Notice of Allowance issued Jul. 18, 2011.
U.S. Appl. No. 12/612,257, filed Nov. 4, 2009; Richard D. Smith; notice of allowance dated Jul. 23, 2012.
U.S. Appl. No. 13/245,339, filed Sep. 26, 2011; Richard D. Smith; office action dated Jul. 18, 2012.
U.S. Appl. No. 12/612,252, filed Nov. 4, 2009; Richard D. Smith; notice of allowance dated Jul. 19, 2012.
U.S. Appl. No. 12/422,811, filed Apr. 13, 2009; Richard D. Smith; office action issued Jan. 24, 2011.
U.S. Appl. No. 12/422,821, filed Apr. 13, 2009; Richard D. Smith; office action issued Jan. 7, 2011.
U.S. Appl. No. 12/422,801, filed Apr. 13, 2009; Richard D. Smith; office action issued Jan. 19, 2011.
U.S. Appl. No. 29/346,705, filed Nov. 4, 2009; Richard D. Smith; office action issued Feb. 3, 2011.

U.S. Appl. No. 12/422,792, filed Apr. 13, 2009; Richard D. Smith; office action issued Jan. 19, 2011.
U.S. Appl. No. 12/755,954, filed Apr. 7, 2010; Richard D. Smith; office action dated Sep. 26, 2012.
U.S. Appl. No. 12/755,995, filed Apr. 7, 2010; Richard D. Smith; office action dated Oct. 5, 2012.
U.S. Appl. No. 12/757,218, filed Apr. 9, 2010; Richard D. Smith; office action dated Jan. 25, 2013.
U.S. Appl. No. 13/245,339, filed Sep. 26, 2011; Richard D. Smith; office action dated Feb. 14, 2013.

* cited by examiner

MESH CHAIR WITH OPEN-END HOOP

PRIORITY CLAIM(S)

This is a continuation-in-part of U.S. patent application Ser. Nos. 12/612,252 now U.S. Pat. No. 8,317,269 and 12/612,257, now U.S. Pat. No. 8,322,787 filed on Nov. 4, 2009; which claim priority to U.S. Provisional Patent Application Ser. No. 61/168,837, filed Apr. 13, 2009; which are hereby incorporated by reference in their entirety.

Priority is claimed to U.S. Provisional Patent Application Ser. No. 61/168,837, filed Apr. 13, 2009, which is hereby incorporated herein by reference in its entirety.

This is a continuation-in-part of U.S. patent application Ser. Nos. 12/422,792; now U.S. Pat. No. 8,033,598; 12/422,801; now U.S. Pat. No. 8,033,612; 12/422,811 now U.S. Pat. No. 8,029,059 and 12/422,821, now U.S. Pat. No. 8,038,221 filed on Apr. 13, 2009; which claim priority to U.S. Provisional Patent Application Ser. No. 61/140,756, filed Dec. 24, 2008; which are hereby incorporated by reference in their entirety.

RELATED APPLICATION(S)/PATENT(S)

This is related to U.S. Design Pat. No. D599,127, issued Sep. 1, 2009, and filed Apr. 13, 2009; which is incorporated herein by reference in its entirety.

This is related to U.S. Design application Ser. No. 29/346,705, filed Nov. 4, 2009; which is incorporated herein by reference in its entirety.

BACKGROUND

1. Field of the Invention

The present invention relates generally to mesh folding and/or stacking chairs.

2. Related Art

Folding or stacking chairs are often used in situations in which it is desirable or necessary to provide varying numbers and/or varying layouts of chairs, such as during conventions, seminars, conferences, etc. In addition, folding or stacking chairs are often used in multipurpose areas in which patron seating is required for some functions, but a large open space is required for other functions necessitating storage of the chairs. For example, some organizations have buildings with a multipurpose room which may be used for banquets, seminars, conventions, etc., with chairs set up, or for a dance, sporting event, etc., with the folding chairs removed. Furthermore, folding or stacking chairs are often used domestically/residentially to accommodate larger dinner-parties or the like.

It is desirable that the folding or stacking chairs be capable of being folded and/or stacked for storage so that the chairs take up less room when they are not required. It will be appreciated that some situations or events will require thousands of folding chairs, all of which may need to be folded and stored at any given period. Thus, the chairs must be stored such that they have a high storage density to minimize the storage space required. It will be appreciated that any extra thickness of a chair when folded becomes significant when numerous folding chairs are involved. For example, with a thousand stacked folding chairs, a folding chair which saves one extra inch in the folded position results in over 80 linear feet of saved storage space. In addition, it will be appreciated that numerous stacked chairs can be difficult to handle or store, and may separate from one another. Furthermore, it will be appreciated that chairs can be unsymmetrical so that stacking several chairs together results in a non-linear stack which can lead to separation.

One disadvantage with many prior art folding chairs is the bulk or thickness of the chair in the folded position. Many typical folding chairs still remain several inches thick in the folded position, and thus are less dense when stored. For example, many typical folding chairs have seats which fold adjacent to or abutting the legs, such that the thickness of the chairs in the folded position comprises the thickness of the legs and the seat.

In addition, it is desirable that the folding or stacking chairs be easily storable or stackable, and be stable when stored/stacked. Many typical prior art folding chairs are stored merely by leaning one chair against a wall and subsequent chairs in a series against the first chair. It will be appreciated that a plurality of folding chairs stacked against a wall has a potential domino effect, with all of the chairs subject to being knocked over. Other prior art folding chairs have complicated and expensive hanging rack systems. For example, a wheeled cart might have a plurality of support arms from which a plurality of folding chairs is suspended. One disadvantage of these types of systems is that chairs on the end of the hangers tend to fall off the rack, and the wheeled racks are difficult to move and maneuver. It also is desirable that the chairs be comfortable. Typical prior art folding or stacking chairs have rigid metal seats and seat backs which can be hard and uncomfortable. One disadvantage of many prior art folding chairs is that the chairs either fold or stack well and are uncomfortable, or are comfortable but are awkward in folding or stacking. Thus, there tends to be a trade off between comfort and foldability. Some chairs provide a cushion. But these chairs still utilize the rigid metal seat bottoms and seat backs, and the cushions tend to make the chairs even thicker when folded. For example, see U.S. Pat. Nos. 2,877,829 and D357,365.

Other types of chairs, such as office chairs, have been design for greater comfort and aesthetic appearance, but which do not fold or stack. For example, see U.S. Pat. Nos. 6,125,521 and 7,249,802.

Furthermore, it will be appreciated that such chairs can be made and shipped in great quantities, and that such stacking chairs can occupy a large volume, resulting in shipping expense or inefficiencies.

SUMMARY OF THE INVENTION

It has been recognized that it would be advantageous to develop a folding or stacking chair with greater comfort while maintaining high density storage. In addition, it has been recognized that it would be advantageous to develop a chair utilizing a mesh seating surface for comfort and space saving in a folding chair or stacked configuration. In addition, it has been recognized that it would be advantageous to develop a chair utilizing the comfort of a mesh seating surface in a folding and/or stacking chair. In addition, it has been recognized that it would be advantageous to develop such a folding and/or stacking chair with a mesh seating surface that is both economically viable and structurally sound. Furthermore, it has been recognized that it would be advantageous to develop a chair shippable in a disassembled, but ready to assemble, configuration in a thin, knock down box, and that is easily and quickly assembled with few parts.

The invention provides a chair with a seat and a backrest carried between opposite frame sides, each with a backrest support, a front leg and a rear leg. One or both of the seat and the backrest have a continuous sheet of flexible and elastic knitted mesh or patterned open texture plastic held across and substantially covering an opening in an open-end hoop coupled between the frame sides. An open-end of the hoop faces in a front or a back orientation for the seat, or a top or a bottom orientation for the backrest, with sides of the hoop attached to the frame sides. The sheet of mesh or textured plastic has a finished edge spanning the open-end of the hoop.

In addition, the invention provides a chair with a seat and a backrest carried between opposite frame sides each with a backrest support, a front leg and a rear leg. The seat has a continuous sheet of flexible and elastic knitted mesh held taut across and substantially covering an opening in an all-plastic, open-end seat hoop, with the seat hoop coupled between the frame sides. The seat hoop has an open-end back, a front cross-bar and lateral sides attached to the frame sides. A corresponding perimeter of the sheet of mesh is embedded in the front cross-bar and lateral sides. A finished edge of the sheet of mesh spans the open-end back. The finished edge has a heavier knit. The backrest has a continuous sheet of flexible and elastic knitted mesh held taut across and substantially covering an opening in an all-plastic, open-end backrest hoop, with the backrest hoop coupled between the backrest supports of the frame sides. The backrest hoop has an open-end bottom, a top cross-bar and lateral sides attached to the backrest supports of the frame sides. A corresponding perimeter of the sheet of mesh is embedded in the top cross-bar and lateral sides. A finished edge of the sheet of mesh spans the open-end bottom. The finished edge has a heavier knit. A gap is formed between the finished edge of the seat and the finished edge of the backrest.

In addition, the invention provides a chair with a seat and a backrest carried between opposite frame sides each with a backrest support, a front leg and a rear leg. The seat has a continuous sheet of flexible and elastic knitted mesh held taut across and substantially covering an opening in an all-plastic, open-end seat hoop, with the seat hoop coupled between the frame sides. The seat hoop has an open-end back, a front cross-bar and lateral sides attached to the frame sides. A corresponding perimeter of the sheet of mesh is embedded in the front cross-bar and lateral sides. A finished edge of the sheet of mesh spans the open-end back. The finished edge has a heavier knit. The backrest has a continuous sheet of flexible and elastic knitted mesh held taut across and substantially covering an opening in an all-plastic, open-end backrest hoop, with the backrest hoop coupled between the backrest supports of the frame sides. The backrest hoop has an open-end bottom, a top cross-bar and lateral sides attached to the backrest supports of the frame sides. A corresponding perimeter of the sheet of mesh is embedded in the top cross-bar and lateral sides. A finished edge of the sheet of mesh spans the open-end bottom. The finished edge has a heavier knit. A gap is formed between the finished edge of the seat and the finished edge of the backrest. A front leg support extends between front legs, and a rear leg support extends between rear legs. Both the front and rear leg supports are within five inches of where the seat attaches to the frame sides. Only four cross-bars extend between frame sides, including: the front and rear leg supports, the front of the seat hoop and the top of the backrest hoop.

Furthermore, the invention provides a chair with a seat and a backrest carried between opposite frame sides each with a backrest support, a front leg and a rear leg. The seat has a continuous sheet of flexible and elastic knitted mesh held taut across and substantially covering a space between a pair of parallel seat sides, each coupled to a different one of the frame sides. At least one open seat end is defined by the pair of parallel seat sides, with the sheet of mesh having a finished edge extending across the open seat end. A seat cross bar extends between the pair of parallel seat sides. The backrest has a continuous sheet of flexible and elastic knitted mesh held taut across and substantially covering a space between a pair of parallel backrest sides, each coupled to a different one of the backrest supports of the frame sides. At least one open backrest end is defined by the pair of parallel backrest sides, with the sheet of mesh having a finished edge extending across the open backrest end. A backrest cross bar extending between the pair of parallel backrest sides.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Most or all of the mesh or patterned plastic has been removed from the figures for clarity of the chair, seat, backrest and hoops. But the mesh or patterned plastic is understood to extend across the entire opening of the hoops.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

The invention provides a chair, such as a folding or stacking chair, with a sheet of mesh or patterned plastic as part of a seat and/or backrest. The seat and/or backrest can have an open end hoop carrying the sheet of mesh or patterned plastic. A finished end of the sheet of mesh or patterned plastic can extend across an open end of the hoop. The open end of the hoop can provide comfort by eliminating a cross-bar that might press against a user's, legs, buttocks, and/or back. In addition, the open end of the hoop can reduce material costs and shipping costs. The seat can include an open back end that can eliminate a cross bar at the user's buttocks; and/or an open front end that can eliminate a cross bar at the user's legs or thighs. Similarly, the backrest can include an open bottom and/or an open top that can eliminate a cross bar at the user's back or lumbar.

As illustrated in FIGS. 1*a*-4*g*, a folding chair, indicated generally at 10, with a mesh seat 14 and a mesh backrest 18 is shown in an example implementation in accordance with the invention. Such a folding chair can be utilized by institutions or residentially. The mesh seat and backrest have a stretched mesh over all-plastic and/or open-end frames or hoops to achieve upholstered comfort in a non-upholstered folding and/or stacking chair. In addition, the chair can use the all-plastic and/or open-end frames or hoops with mesh for the seat and the backrest supported by a metal frame sides and legs for a sturdy, strong, and light-weight chair. The seat and the backrest can be plastic and can attach to the frame sides and legs without metal brackets or the like in the seat and backrest. Furthermore, the seat can have a broadly curved front and upper edge, or waterfall edge, to resist a hard surface against a backside of a user's leg. Furthermore, the final shape of mesh back provides lumbar support.

Figure 1A:
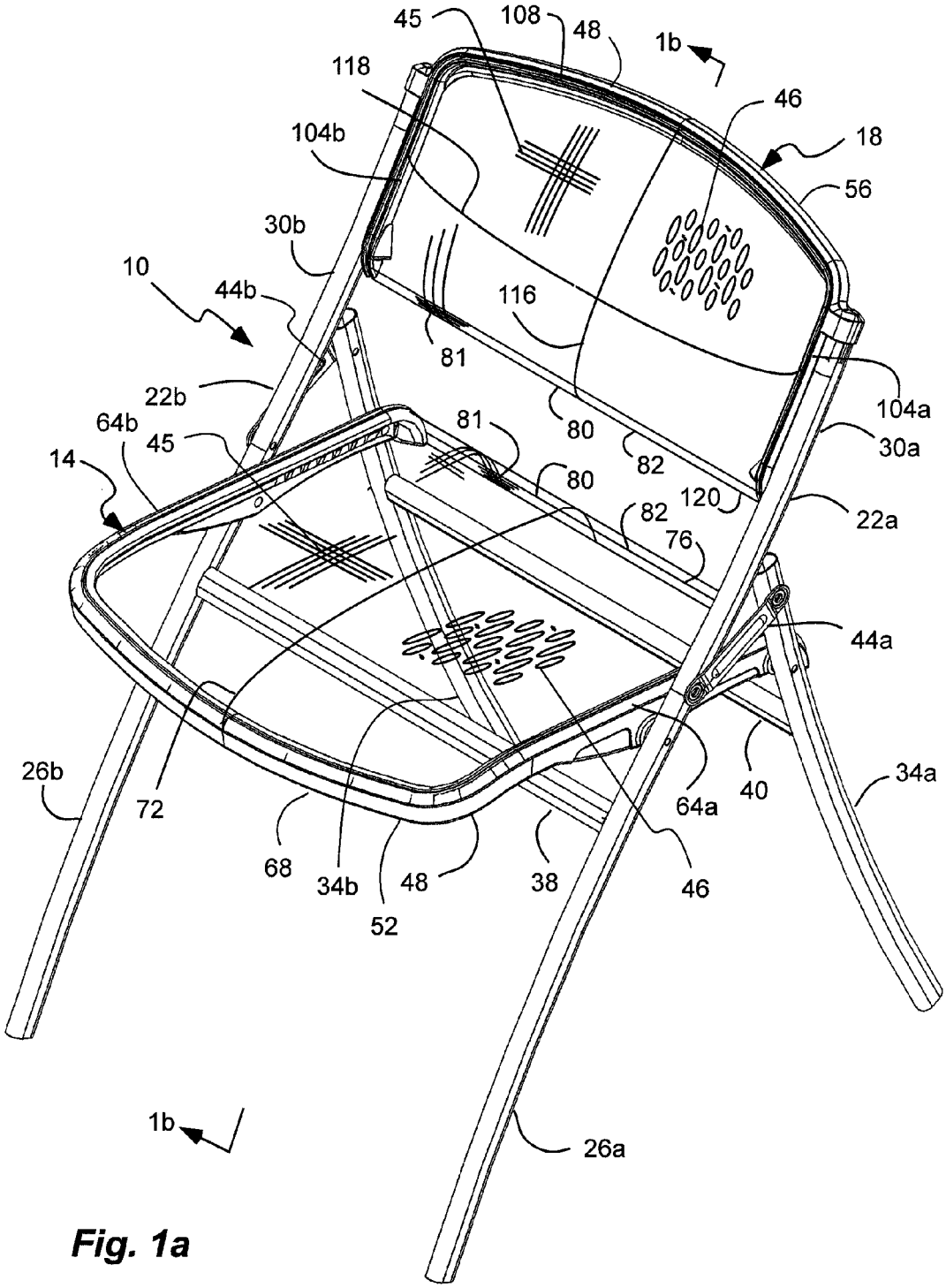
FIG. 1*a* is a front perspective view of a folding chair in accordance with an embodiment of the present invention shown in an unfolded seating position and with mesh of the seat and backrest mostly removed for clarity.

The chair 10 can include a frame with opposite frame sides 22*a* and 22*b* that carry the seat and backrest therebetween. The frame sides can each include an elongated member defining a front leg 26*a* and 26*b* with a lower portion thereof, and a backrest support 30*a* and 30*b* with an upper portion thereof. Thus, the backrest support 30*a* and 30*b* is essentially an extension of the front leg 26*a* and 26*b*. In addition, the opposite side frames can each include a rear leg 34*a* and 34*b*. The frame sides 22*a* and 22*b* can be coupled together by the seat 14 and backrest 18, and by front and rear lower cross members 38 and 40 that extend between the front and rear legs respectively nearer an upper end of the legs, or nearer the seat. The front and rear legs are pivotally or movably coupled together, and pivot or move with respect to one another. The front and rear legs can be coupled together by the seat 14 and a link 44*a* and 44*b*. Thus, the seat 14 is pivotally coupled to both the front and rear legs. Similarly, the link 44*a* and 44*b* is pivotally coupled to both the front and rear legs. The front and rear legs and the backrest support can be formed of metal, such as steel or aluminum, and can be tubular for lighter weight. The cross-sectional shape of the members and chair legs can be elliptical for added strength. In addition, the members can be curvilinear and can have a stretched s-shaped profile to facilitate stacking. The front and rear legs can have matching curvature so that they can nest adjacent one another. The chair 10 can have an unfolded seating position, as shown in FIGS. 1*a*-*h*; and a folded position or a folded and stack position, as shown in FIG. 1*i*. In the unfolded seating position, the seat 14 pivots to extend from the frame sides 22*a* and 22*b* and bottoms of the front and rear legs move apart so that the chair rests on a support surface and a user can sit on the seat. In the folded position, the seat 14 pivots toward the frame sides 22*a* and 22*b* and the front and rear legs move together so that the chair can be stored in less space.

The seat 14 and the backrest 18 can each have a continuous sheet of flexible and elastic mesh (represented by 45 in FIG. 1*a*) held taut across and substantially covering the seat and backrest. The terms "mesh" and "sheet of mesh" are used interchangeably herein to refer to a mesh material that is a continuous sheet in that it essentially consistent in its composition of strands and intervening openings (although it may have a pattern therein) and essentially covers the entirety of the seat and/or backrest (as opposed to individual strands or discrete straps with larger openings therebetween); and that is flexible and elastic in that it readily deflects under the weight of a user and returns to its previous position after unloading (as opposed to an embossed metal or rigid screen). A space can separate the seat and the backrest, and can define a gap between the mesh of the seat and the mesh of the backrest. The space can be sized to receive the seat therein in the folded position, as shown in FIG. 1*i*. The mesh material can include a polypropelene mesh fabric or the like. The mesh can be a woven mesh or a knitted mesh. The mesh material can include 70% elastomer monofilament with a 55 durometer and 30% polyester yarn. The elastomeric monofilament can be a polyester co-polymer (such as Hytrel by Dupont). The interwoven monofilaments can also be bonded together to resist unraveling, for example by using a coextruded monofilament with an outer layer having a lower melting point that melts in an oven to bond to adjacent monofilaments. Openings can be formed through the mesh between the strands. The openings, which may have different sizes based on the pattern of the weave, can have substantially the same size, dimension or width of the strands, or be on the same order. Other types of mesh or compositions of strands with less or more elastomer can be used. As stated above, the mesh can be woven or knitted.

Alternatively, the seat 14 and the backrest 18 can each have a continuous sheet of flexible and elastic patterned open texture plastic (represented by 46 in FIG. 1) held across and substantially covering the seat and backrest. The term "sheet of patterned open texture plastic" is used herein to refer to a plastic material that has a series or arrangement of openings across the sheet and that is continuous in that it is essentially consistent in its composition of structure and openings (although it may have a pattern therein) and essentially covers the entirety of the seat and/or backrest. In addition, the sheet of plastic is flexible and elastic in that it readily deflects under the weight of a user and returns to its previous position after unloading (as opposed to an embossed metal or rigid screen). The sheet of plastic and the material of the sheet of plastic can be selected so that the sheet of plastic can deflect or bend. In addition, the openings can be sized and patterned to facilitate deflection or bending, and to eliminate pressure points. The openings and the material between the openings can be substantially the same size, dimension or width, or on the same order. Alternatively, an opening can be elongated and serpentine to substantially traverse a width, depth or height of seat or backrest. Again, a space can separate the seat and the backrest, and can define a gap between the sheet of plastic of the seat and the sheet of plastic of the backrest. The sheet of plastic and the all-plastic hoop can be formed together, such as by injection molding, so that the seat and backrest are manufactured as a single piece or unit. The all-plastic hoop can be distinguished from the sheet of plastic as a thicker perimeter. In either case, the sheet of mesh or the sheet of plastic can provide the sole or only support of the user's weight. Thus, each side of the sheet of mesh or the sheet of plastic can be free or open, without other materials or fillers, such as foam or cloth. In addition, the sheet of mesh or the sheet of plastic can define a seating surface and backrest surface directly abutting the user without intervening cushion or material.

In one aspect, only the seat can include the mesh supported by a seat frame. In another aspect, only the backrest can include the mesh supported between the backrest supports of the frame sides or a backrest frame. In another aspect, both the seat and the backrest can include the mesh. Whether one of the seat or the backrest or both include mesh can depend on the needs of the user. In addition, the sheet of mesh 45 can be held taut across and substantially cover an opening in an all-plastic hoop 48 fixed between the frame sides. For example, the seat can include an all-plastic seat hoop 52 and the backrest can include an all-plastic backrest hoop 56. The resiliency in the seat and backrest can be suited to the user's preference. In one aspect, the mesh of the seat can be stretched 4.5 to 5%, while the mesh of the backrest can be stretched 2.7 to 3.2%. Thus the backrest can have greater deflection and a softer feel because the loading on the backrest is not as great as the seat. In addition, the mesh can have variable tension along a longitudinal direction (front to back for the seat or top to bottom for the backrest) to provide for great comfort. The degree of lateral tension of the mesh of the backrest can vary along the height or elevation of the backrest to create lumbar support at a desired location. The mesh suspended between the hoops can provide greater comfort that traditional solid plastic or solid metal chairs while maintaining stackability and high density storage of folding chairs. Similarly, the mesh can have variable lateral (side-to-side) tension. The all-plastic hoops can be formed by injection molding plastic, and may be formed of, or can include, polypropylene or nylon or ABS. In one aspect, the hoops can be formed of nylon and the seat hoop 52 can weigh less than 1.875 lbs, the backrest hoop 56 can weigh less than 1.125 lbs, and together can weigh less than 3 lbs, to reduce the weight of the chair while providing sufficient strength. In another aspect, the hoops can be formed of nylon and the seat hoop can weigh less than 1.5 lbs, the backrest hoop can weigh less than 0.75 lbs, and together can weigh less than 2.25 lbs. In another aspect, the hoops can be formed of polypropylene and the seat hoop can weigh less than 1.5 lbs, the backrest hoop can weigh less than 0.75 lbs, and together can weigh less than 2.25 lbs. In another aspect, the hoops can be formed of polypropylene and the seat hoop can weigh less than 1.2 lbs, the backrest hoop can weigh less than 0.6 lbs, and together can weigh less than 1.8 lbs. The amount or weight of the plastic material of the all-plastic hoops is balance to provide sufficient strength to the frame and the sheet of mesh or plastic, while also reducing the weight of the chair. Such a configuration as described above can support a static load of at least 1250 lbs. In another aspect, it is believed that sufficient strength can be provided by a seat hoop with a weight as low as 1.25 lbs, a backrest hoop with a weight as low as 0.5 lbs, and a combined weight as low as 1.75. The all-plastic hoops can be all-plastic without any internal or external metal reinforcement members, although the plastic of the hoops can have fillers such as glass fibers. Thus, the seat and/or backrest hoops support both the mesh and the frame, reducing the number of parts and cost of the chair. The mesh 45 can be bonded, such as chemically or adhesively, in a channel 60 (FIGS. 3*c* and 4*b*) in the hoops, such as by melting the material of the mesh and the hoops together, or by chemical reaction, or with adhesive, or the like. Thus, the sheet of mesh can be attached to the hoop without mechanical fasteners, such as staples. (The mesh is represented by 45 in FIG. 1. Most of the mesh has been removed from the figures for clarity of the chair, seat, backrest and hoops. But the mesh extends across the entire opening of the hoops 48.)

The mesh 45 of the seat 14 and backrest 18 is held taut in the hoops and provides the comfort of an upholstered comfort in a non-upholstered folding chair; while the hoops 48 can provide structural support between the frame sides. As described above, the hoops can provide the support for both the mesh and the frame sides of the folding chair. The all-plastic hoop 56 of the backrest can provide the sole structural support between the backrest supports 30*a* and 30*b* of the frame sides 22*a* and 22*b*. The all-plastic hoop 52 of the seat and the lower cross members 38 and 40 provide structural support between the frame sides 22*a* and 22*b* at a middle of the chair or frame sides. The hoops can be directly coupled to the frame sides, without intervening support members. The seat hoop 52 can be coupled to the frame sides, or front and rear legs, by rivets which also form pivot points. The backrest hoop 56 can couple to the backrest supports as described below. The hoops can be injection molded nylon with a total weight of less than 3 lbs to provide both light weight for ease of folding and unfolding and moving the chairs, and strength to support the taut mesh across the opening and support the frame sides.

The seat 14 and/or seat hoop 52 can be sized and shaped for both comfort and structural support. The seat hoop 52 can have opposite, parallel, substantially straight, hoop sides 64*a* and 64*b* coupled to the frame sides. A front or front cross member 68 extends between the hoop sides and the front and/or front ends of the frame sides can arc downward (with respect to the chair in the unfolded seating position), or form an arc. The sheet of mesh 45 held taut between the seat hoop forms a longitudinal convex arc (represented at 72) at the front defining a leg relief near the front of the hoop of the seat.

The mesh arc 72 or thigh support can have a broad downward curvature to provide comfort to the user's legs or thighs when seated. The seat hoop 52 can have a substantially square shape with rounded corners. The front 68 of the seat hoop 52 can curve forwardly out of the square shape and downwardly out of the plane of the square.

Figures 1B, 1C:
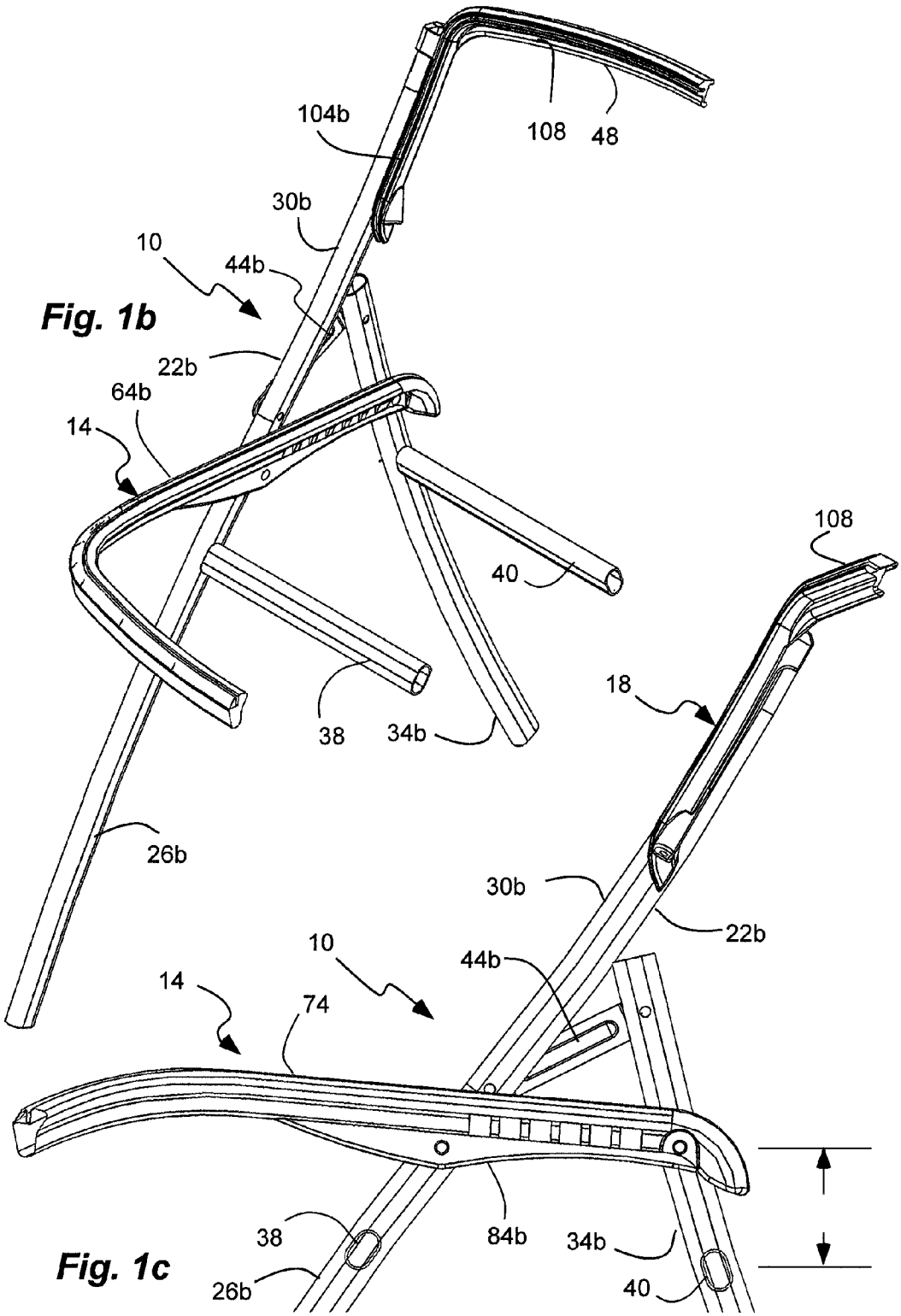
FIG. 1*b* is a cross-sectional perspective view of the folding chair of FIG. 1*a* taken along line 1*a*-1*a;*
FIG. 1*c* is a partial detailed cross-sectional side view of the folding chair of FIG. 1*a;*
Figure 1D:
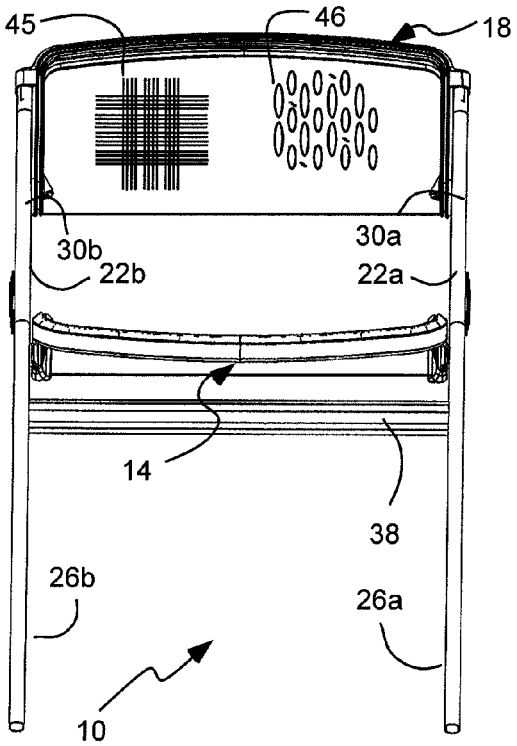
FIG. 1*d* is a front view of the folding chair of FIG. 1*a;*
Figure 1E:
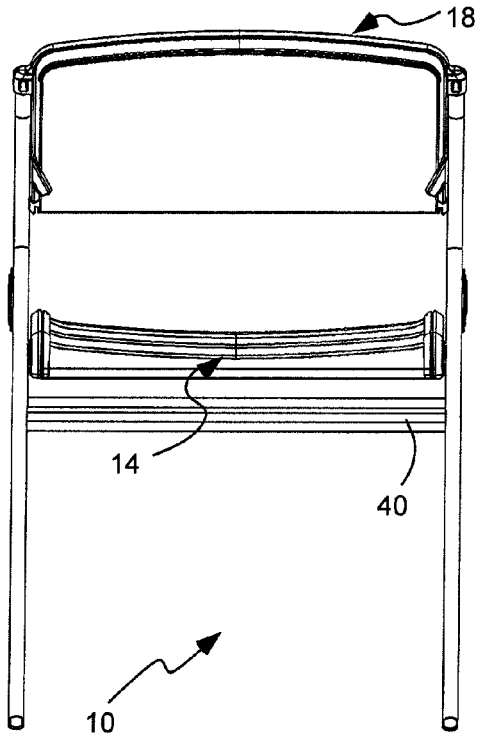
FIG. 1*e* is a back view of the folding chair of FIG. 1*a;*
Figure 1F:
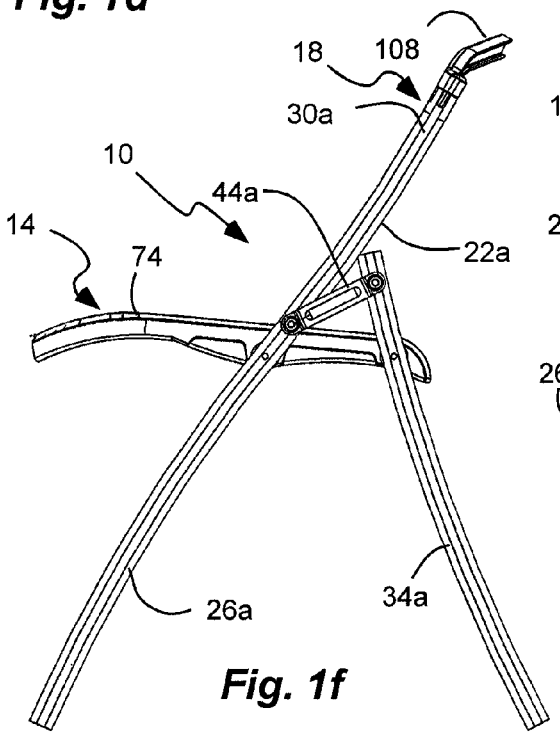
FIG. 1*f* is a side view of the folding chair of FIG. 1*a;*
Figure 2:
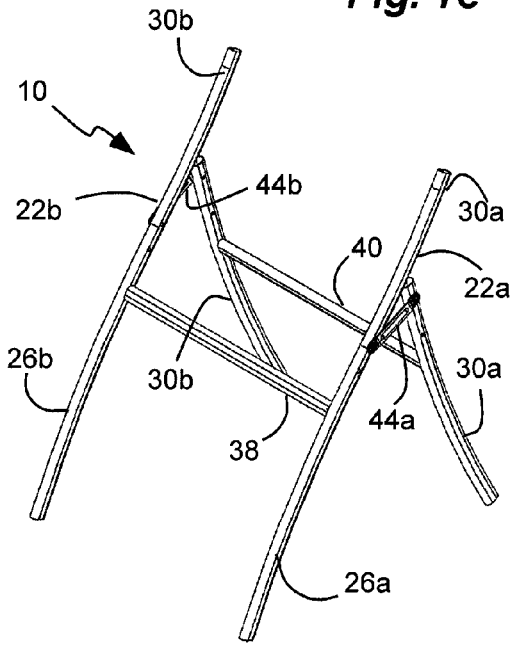
FIG. 2 is a perspective view of a frame of the folding chair of FIG. 1*a*, shown with a seat and backrest removed.
Figure 1G:
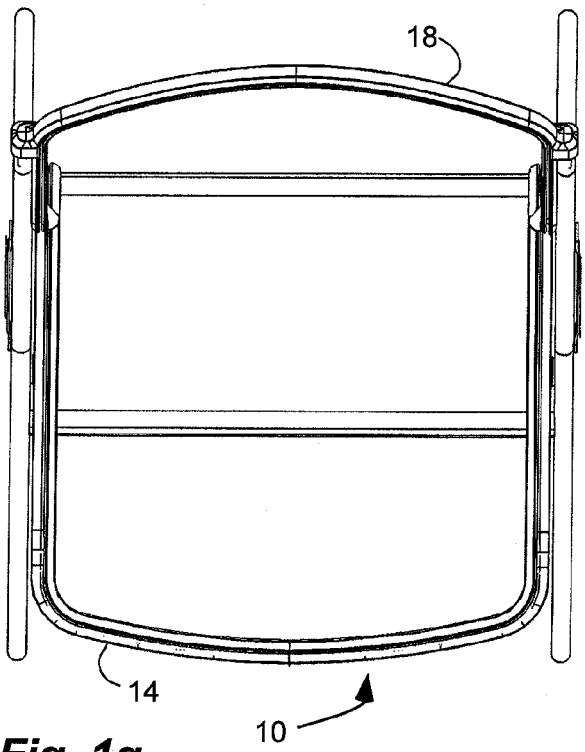
FIG. 1*g* is a top view of the folding chair of FIG. 1*a;*
Figure 1H:
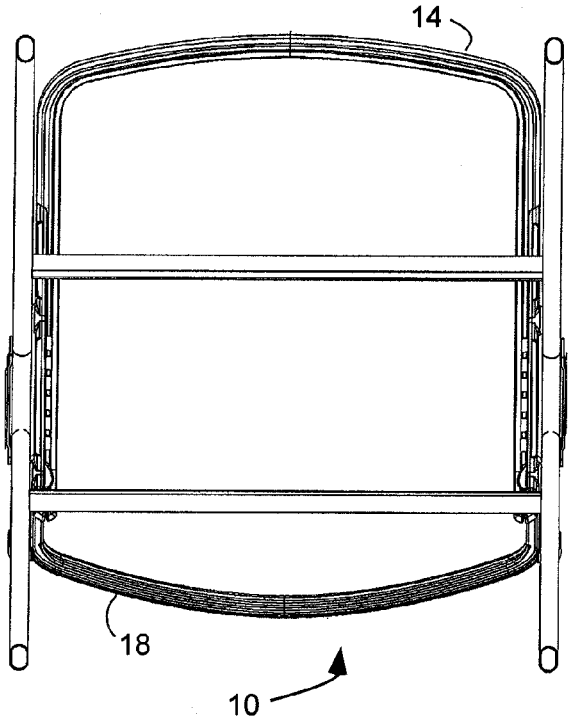
FIG. 1*h* is a bottom view of the folding chair of FIG. 1*a*
Figure 1I:
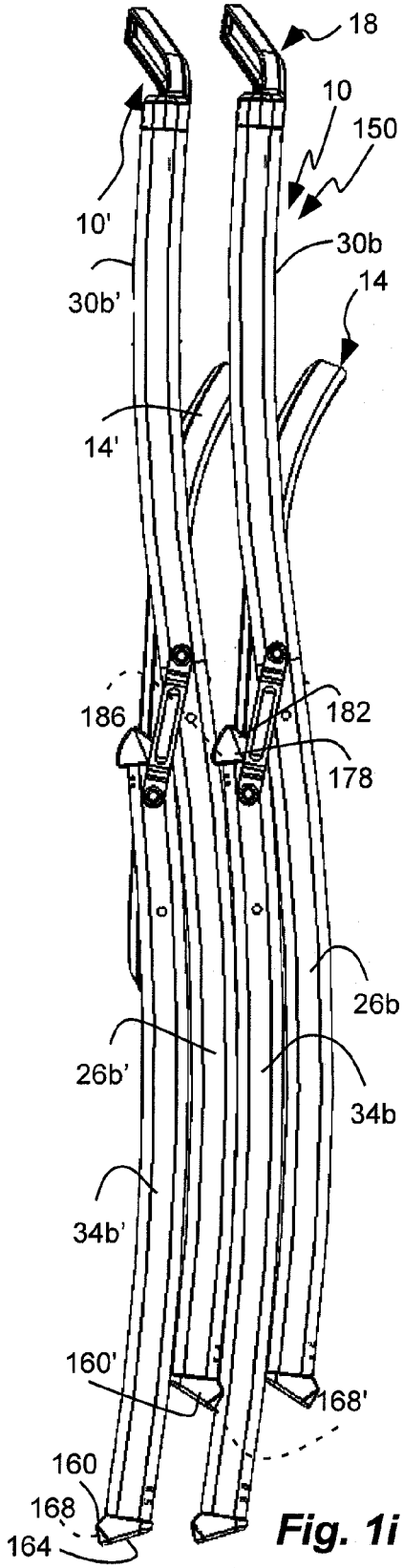
FIG. 1*i* is a side view of the folding chair of FIG. 1*a* show in a folded and stacked configuration with an adjacent chair.
Figure 3A:
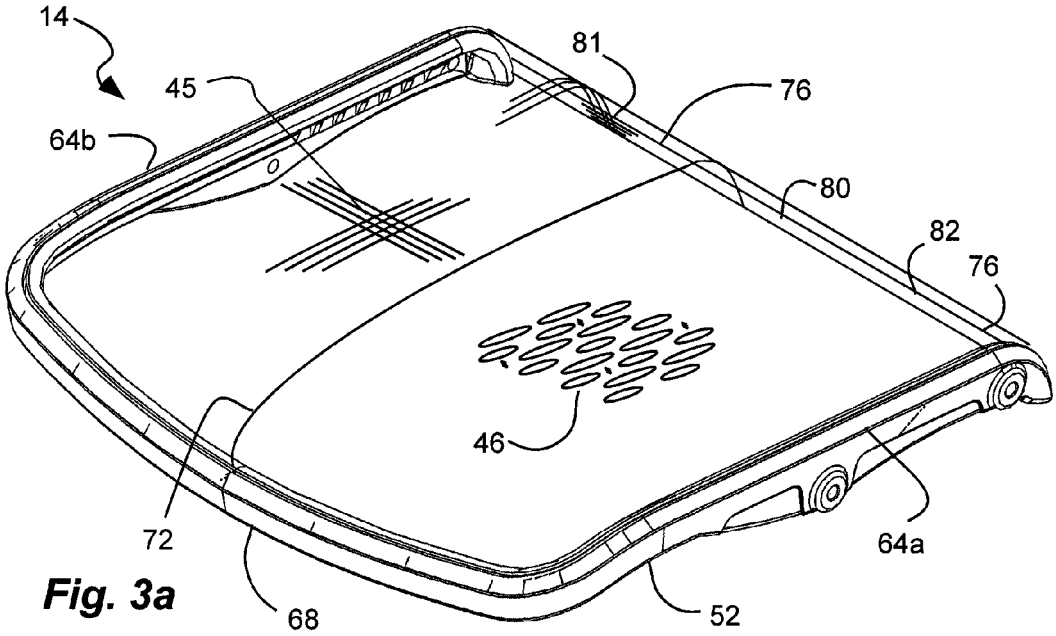
FIG. 3*a* is a perspective view of a seat of the folding chair of FIG. 1*a;*
Figure 3B:
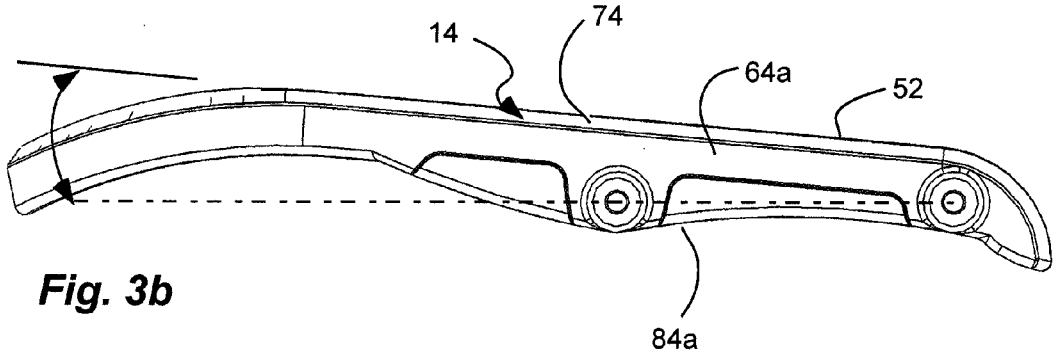
FIG. 3*b* is a side view of the seat of FIG. 3*a;*
Figure 3C:
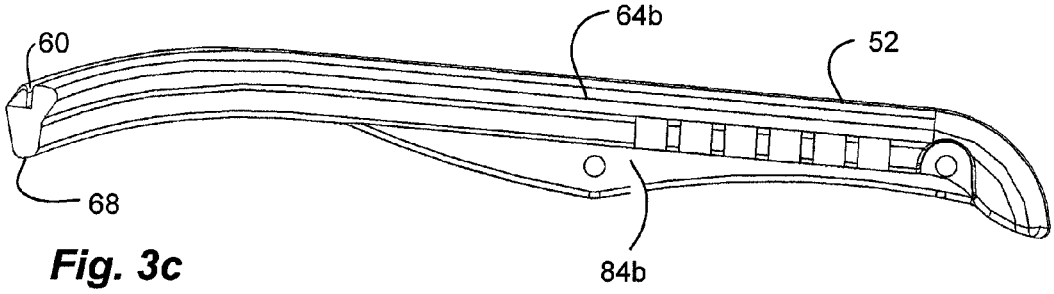
FIG. 3*c* is a cross-sectional side view of the seat of FIG. 3*a;*
Figure 3D:
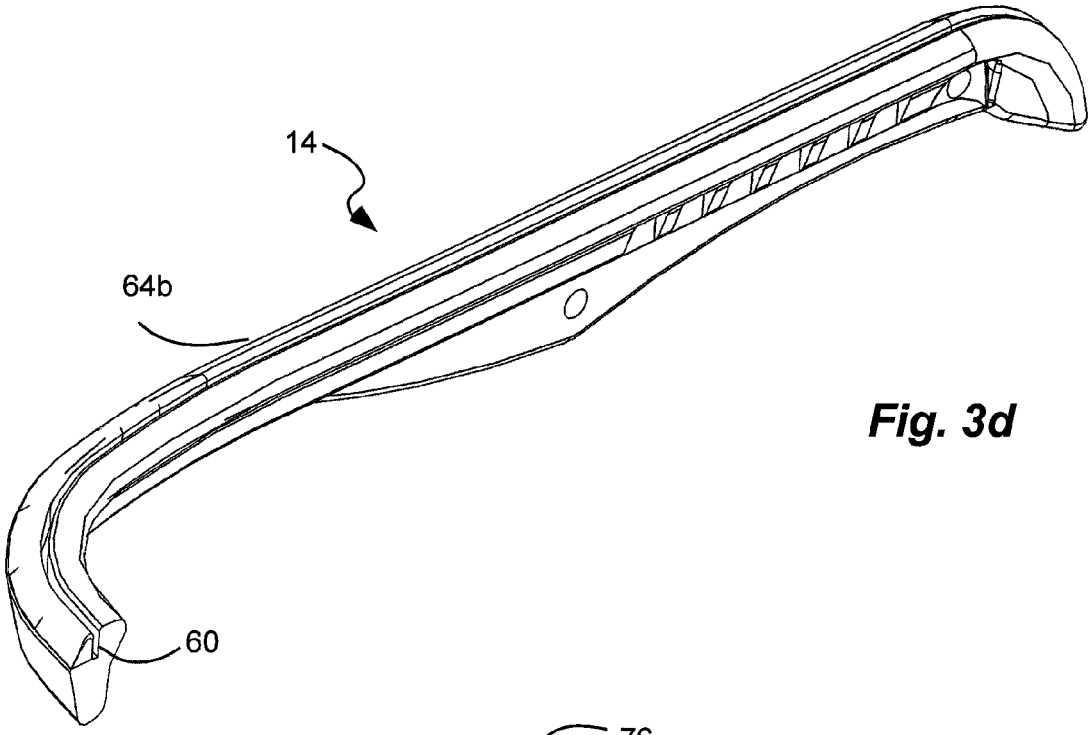
FIG. 3*d* is a cross-sectional perspective view of the seat of FIG. 3*a;*
Figure 3E:
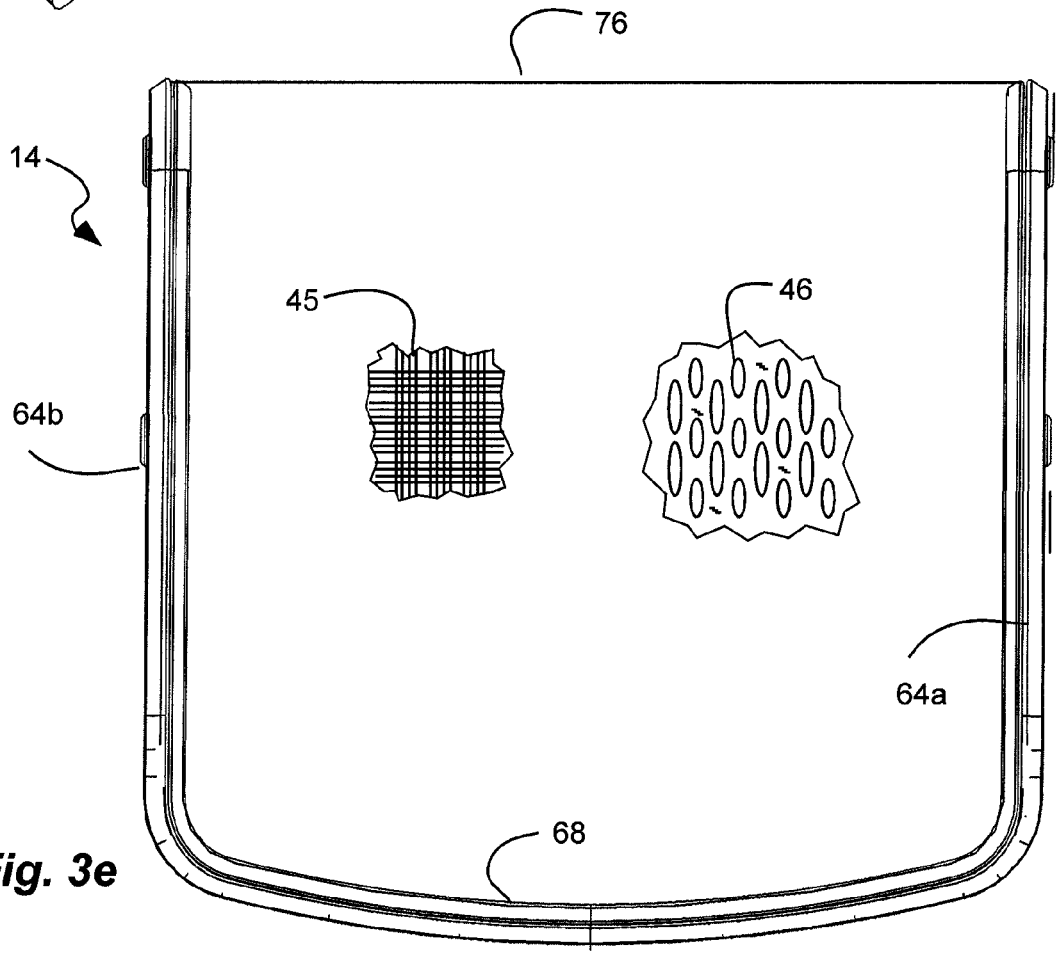
FIG. 3*e* is a top view of the seat of FIG. 3*a;*
Figure 4A:
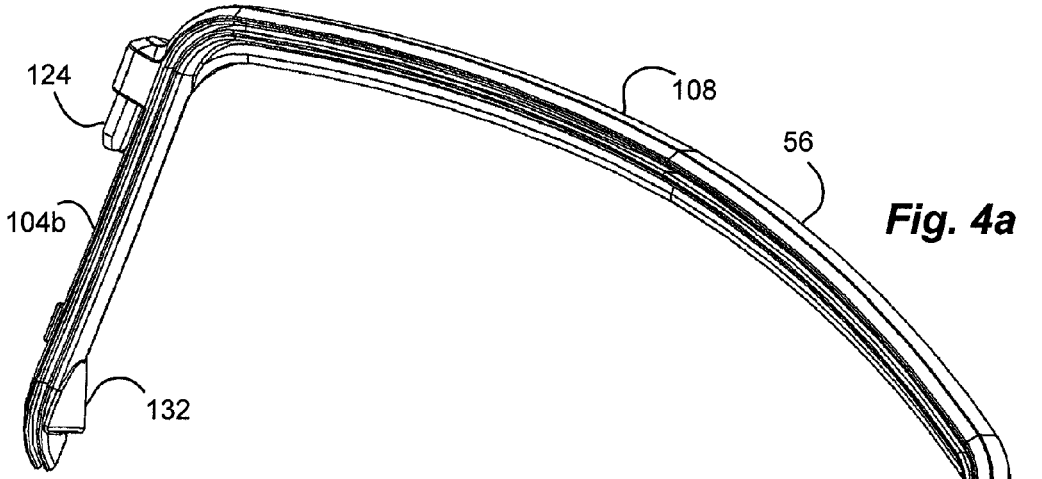
FIG. 4*a* is a perspective view of a backrest of the folding chair of FIG. 1*a;*
Figure 4B:
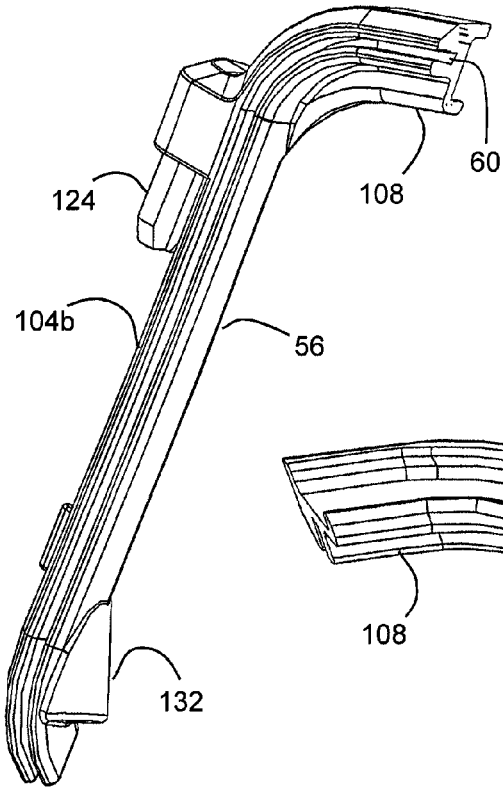
FIG. 4*b* is a cross-sectional perspective view of the backrest of FIG. 4*a;*
Figure 4C:
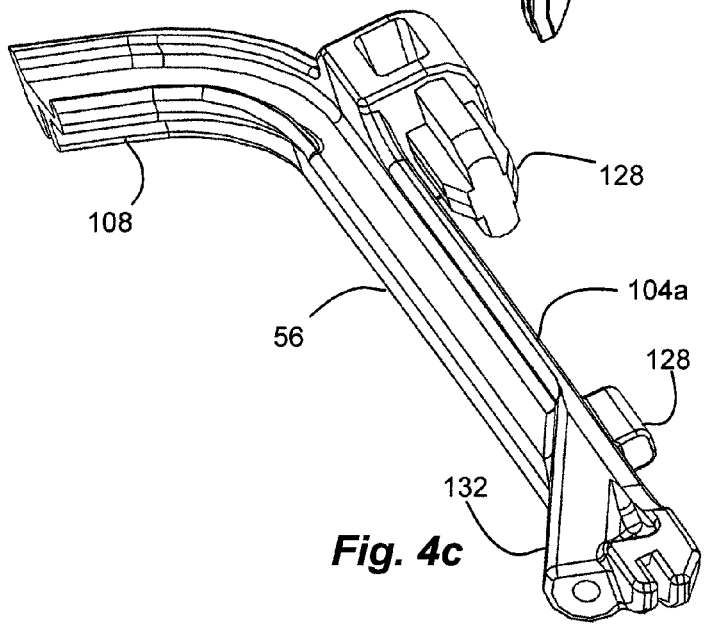
FIG. 4*c* is a cross-sectional perspective view of the backrest of FIG. 4*a;*
Figure 4D:
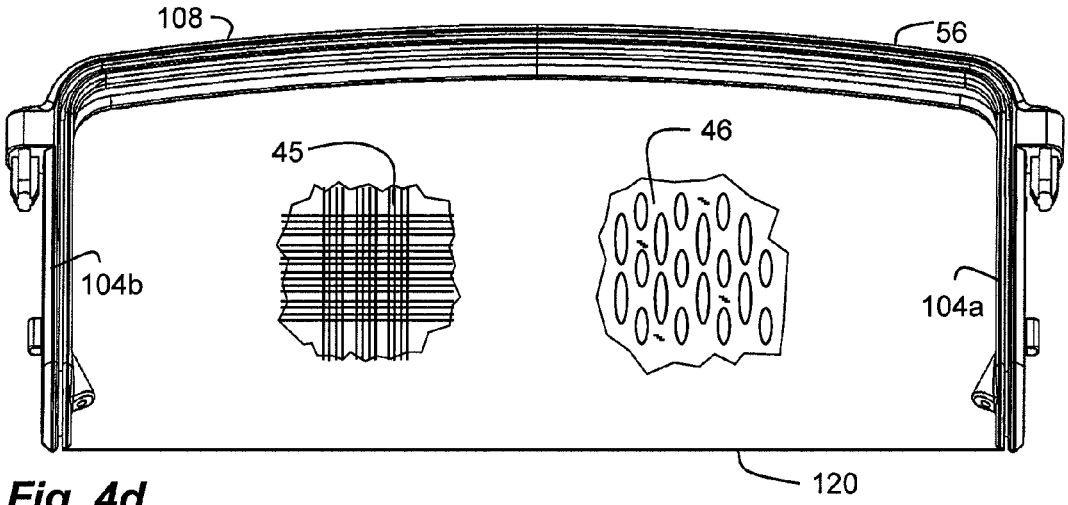
FIG. 4*d* is a front view of the backrest of FIG. 4*a;*
Figure 4E:
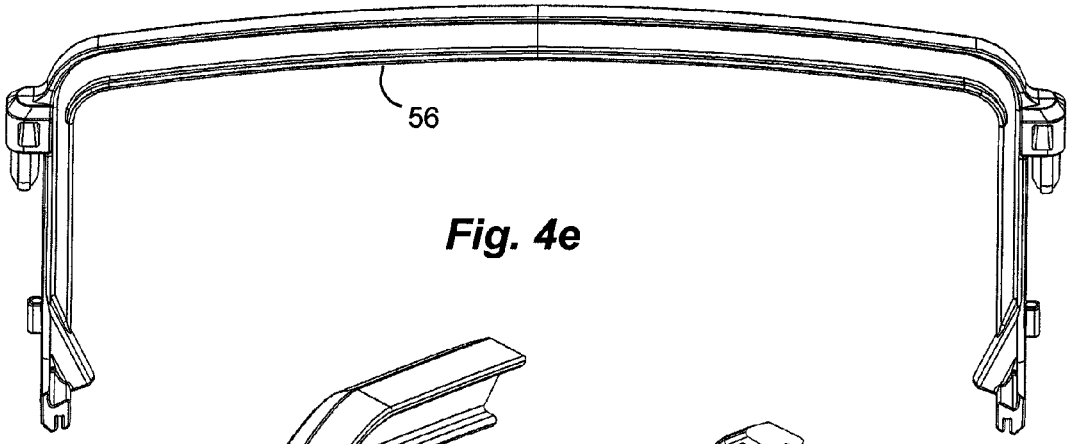
FIG. 4*e* is a back view of the backrest of FIG. 4*a;*
Figure 4F:
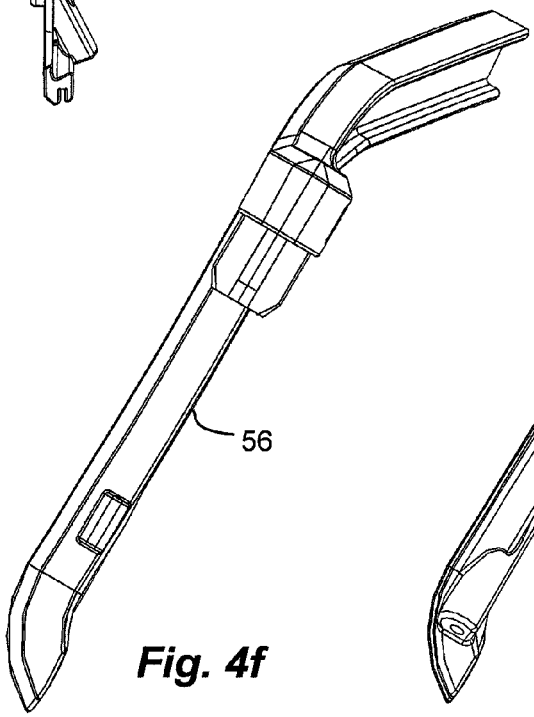
FIG. 4*f* is a side view of the backrest of FIG. 4*a;*
Figure 4G:
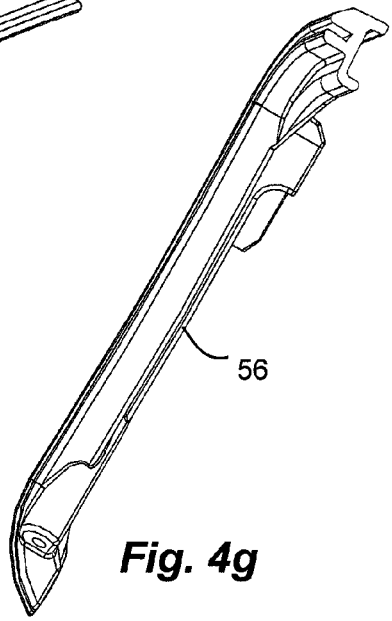
FIG. 4*g* is a cross-sectional side view of the backrest of FIG. 4*a;*

An upper surface 74, or majority thereof, of the seat is oriented at an incline with respect to horizontal in the unfolded seating position, as shown in FIG. 1*c*. The seat can be inclined between 3-7 degrees, or approximately 5 degrees, with respect to horizontal. The incline of the surface of the seat in combination with the deflection of the mesh form a more comfortable seating surface. The seat can be pivotally coupled to the frame sides by a pair of pivotal couplings including the front leg pivotally coupled to the lobe 84*a* and 84*b* described below and the rear leg pivotally coupled to the seat. The upper surface of the seat is disposed at an incline angle of between 3-7 degrees with respect to the pair of couplings due to the lobe. The width of the seat and/or seat hoop at a perimeter of the hoop can be equal to or greater than 17 inches. In another aspect, the width of the seat and/or seat hoop at a perimeter of the hoop can be equal to or greater than 17.5 inches. The width in combination with the mesh forms a more comfortable seating surface. The width of the chair at an outside of the opposite frame sides can be equal to or greater than 19 inches. Thus, the chair combines comfort in a compact size for storage.

One or both of the hoops 48 can be open-end hoops. The open-end hoop can form a yoke or fork with the sheet of mesh or plastic suspended therein. The open-end hoop, yoke or fork can have a block U-shape with rounded corners and an open end. The arms of the hoop, yoke or fork can be coupled at one or more points to the frame sides. The arms or sides of the seat hoop can form a portion of the frame sides, while the base of the seat hoop can form a cross-bar between the frame sides. Similarly, the base of the backrest hoop can form a cross-bar between the frame sides. The hoop, yoke or fork, or the arms and base thereof, can be a single unitary member integrally formed together as a monolithic structure. The sheet of mesh or plastic can have three sides embedded in the hoop, yoke or fork, with a fourth side spanning the opening of the hoop, yoke or fork. Thus, the fourth side spanning the opening can be a free side of the mesh that can be held taught by the hoop, yoke or fork, but capable of bending under the load of a seated user to provide comfort and resist pressure points. In addition, the open end of the hoop, yoke or fork can reduce material, thus reducing cost and weight.

Figure 5:
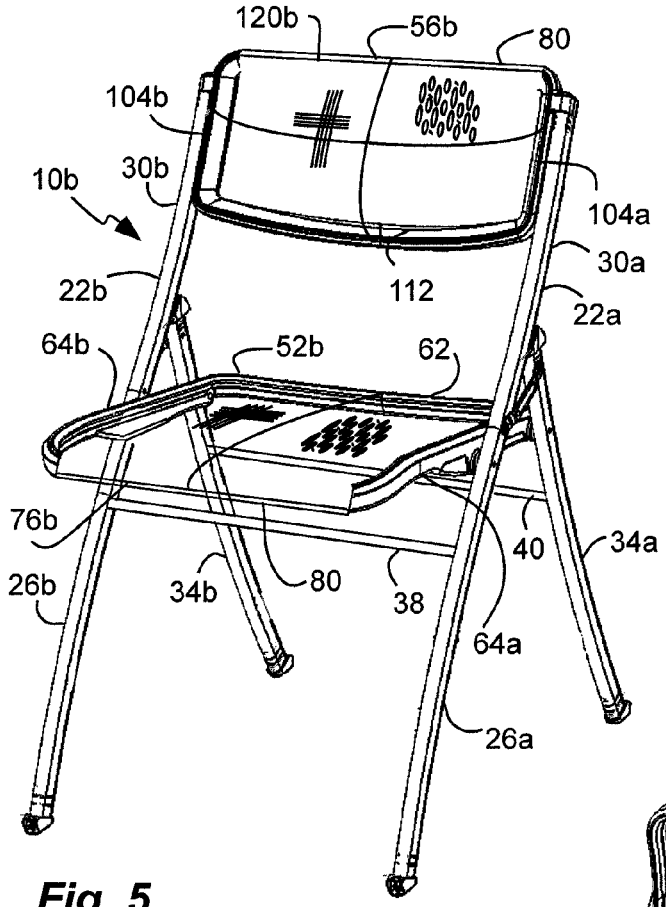
FIG. 5 is a perspective view of another folding chair in accordance with another embodiment of the present invention shown in an unfolded seating position and with mesh of the seat and backrest mostly removed for clarity.

An open-end back 76 of the seat hoop 52 can facing in a rearward or back orientation, as shown in FIG. 1*a*. Thus, the seat hoop 52 can have the open-end back 76, the front cross-bar 68, and lateral sides 64*a* and 64*b*. Alternatively, an open-end front 76*b* of the seat hoop 52*b* can face in a forward or front orientation, as shown in FIG. 5. A perimeter of the sheet of mesh 45 corresponding to the front cross-bar 68 and lateral sides 64*a* and 64*b* is embedded in the front cross-bar and lateral sides. The sheet of mesh 45 or textured plastic 46 can have a finished edge 80 spanning the open-end 76 of the hoop. The finished edge 80 can be a heavier knit (represented by 81) in the knit mesh 45. The heavier knit 81 can be a more dense knit with greater thread count, such as twice the number of threads or strands. In addition, the finished edge 80 can also be thicker, with thicker strands, or overlapping strands, such as two to four strands overlapping. Alternatively, the finished edge 80 can be a heavier and/or thicker plastic edge (represented by 82) in the sheet of plastic 46. The plastic edge 82 can be continuous and uninterrupted, without openings. In addition, the mesh 45 at the rear of the seat can be turned down or dropped down forming a curve with the finished edge 80 transverse to the mesh of the seat.

As described above, the front leg support 38 and the rear leg support 40 can both be disposed closer to where the seat attaches to the frame sides than a bottom of the legs, such as within five inches in one aspect, or within three inches in another aspect. The proximity of the leg supports to the seat provide support for the open-end seat hoop 52.

As described above, the all-plastic seat hoop 52 can be directly coupled to the frame sides 22*a* and 22*b* without external support members. A pair of lobes 84*a* and 84*b* can extend downwardly from lateral sides of the seat hoop 52 in the unfolded seating position. Each frame side 22*a* and 22*b*, or front and rear legs, can be pivotally coupled to a different one of the lobes 84*a* and 84*b* respectively. The lobes can be formed by plastic along with the chair hoop. Integral plastic spacers can extend laterally beyond the chair hoop towards and abutting to the frame sides, or front and rear legs, to form a space between the frame sides and the chair hoop. The spacers can facilitate pivotal motion between the seat and the frame sides. The spacers form a bearing surface and can reduce part count by replacing traditional separate washers. The spacers can be integrally formed with the chair hoop or lobes. A bore extends through the spacers in the lobes and receives a mechanical fastener. The rivet can extend through the bore in the lobes and spacers, and through the frame sides or front and rear legs. The seat can pivot about the rivets with respect to the frame sides or front and rear legs. A recess or counter bore can be formed about the bore adjacent to the frame side to facilitate insertion of the rivet during assembly.

The seat 14 and/or seat hoop 52 forms a four-bar, four-pivot linkage on each side along with the front leg 26*a* and 26*b*, the rear leg 34*a* and 34*b*, and the link 44*a* and 44*b*. As described above, the seat hoop 52 can be all-plastic. The front and rear legs, and the links, can be non-plastic, such as steel or aluminum. Thus, the seat and/or seat hoop forms a single all-plastic link in the four-bar linkage. The front legs 26*a* and 26*b* and backrest supports 30*a* and 30*b* can be formed of at least 16 gauge steel with an oval or elongated tubular cross section. The rear legs 34*a* and 34*b* can be formed of at least 18 gauge steel also an oval or elongated tubular cross section. The rivets can be at least 5/16". It is believed that the above described configuration provides a sufficient balance of weight savings and strength.

The backrest 18 and/or backrest hoop 56 can be sized and shaped for both comfort and structural support. The backrest hoop 56 can have opposite, parallel, substantially straight, lateral hoop sides 104*a* and 104*b* coupled to the backrest supports 30*a* and 30*b* of the frame sides. A top or top cross-bar 108 extends between the top ends of the hoop sides. The top can have an upward curvature. The sheet of mesh 45 stretched taut between the backrest hoop forms an upright convex arc (represented at 116) between the top and the bottom, and a lateral concave arc (represented at 118) between the hoop sides. The backrest hoop 56 can have a substantially square shape with rounded corners. The top 108 of the backrest hoop 56 can curve outwardly out of the square shape in the plane of the square.

The backrest hoop 56 can be an open-end backrest hoop. An open-end bottom 120 of the backrest hoop 56 can facing in a down or downward orientation, as shown in FIG. 1*a*. Thus, the backrest hoop 56 can have the open-end bottom 120, the top cross-bar 108, and lateral sides 104*a* and 104*b*. Alternatively, an open-end top 120*b* of the backrest hoop 56*b* can face in a forward or front orientation, as shown in FIG. 5. A perimeter of the sheet of mesh 45 corresponding to the top cross-bar 108 and lateral sides 104*a* and 104*b* is embedded in the top cross-bar and lateral sides. The sheet of mesh 45 or textured plastic 46 can have a finished edge 80 spanning the open-end 120 of the hoop. The finished edge 80 can be a heavier knit (represented by 81) in the knit mesh 45. The heavier knit 81 can be a more dense knit with greater thread count, such as twice the number of threads or strands. In addition, the finished edge 80 can also be thicker, with thicker strands, or overlapping strands, such as two to four strands overlapping. Alternatively, the finished edge 80 can be a heavier and/or thicker plastic edge (represented by 82) in the sheet of plastic 46. The plastic edge 82 can be continuous and uninterrupted, without openings. In addition, the mesh 45 at the bottom of the backrest can be turned back or dropped back forming a curve with the finished edge 80 transverse to the mesh of the backrest. As described above, a gap is defined between the finished edge of the seat and the finished edge of the backrest.

The chair can have only four cross-bars between frame sides 22*a* and 22*b*, including the front and rear leg supports 38 and 40, the front or front cross-bar 68 of the seat hoop 52, and the top or top cross-bar 108 of the backrest hoop 56. The front and rear leg supports 38 and 40, along with the top cross-bar 108 (or other cross-bar associated with the backrest) can form the only support extending between the frame sides 22*a* and 22*b*. Such a configuration provides sufficient and efficient support for the chair.

The all-plastic and/or open-end backrest hoop 56 can be directly coupled to the backrest supports 30*a* and 30*b* of the frame sides 22*a* and 22*b*. As described above, the backrest supports of the frame sides can have a tubular configuration with an open top end. The open top ends can be oriented orthogonal to the tube and can form a flat annular opening. The backrest hoop 56 has a pair of shoulders that extend from the hoop and over the open top ends of the backrest supports to cover the openings. In addition, the backrest hoop includes a pair of opposite side fingers 124 (FIGS. 4*a-g*) that extend over and into the open top end to provide support between the backrest supports and to cover the open top end. The shoulders and/or fingers can have a step with a larger upper portion covering the tube, or flat annular opening, and a narrower lower portion extending into the tube and abutting the inner surface of the tube. The top cross-bar 108 with the fingers 124 coupled to the backrest supports 30*a* and 30*b* can hold the backrest supports together. A snap lock can be formed between the backrest hoop and the backrest supports. A tab 128 extends from the backrest hoop 56 or the lateral hoop sides 104*a* and 104*b* thereof, and into corresponding openings of the backrest supports. The lateral hoop sides 104 and 104*b* can be flexible and can flex or bend inwardly as the backrest hoop is inserted between the backrest supports 30*a* and 30*b*. The lateral hoop sides are resilient to snap the tabs into the corresponding openings, with a side of the tabs abuts the openings, resisting removal of the backrest hoop from the backrest supports. In addition, an angled bore and collar 132 is formed on the interior of the backrest hoop or lateral hoop sides 104*a* and 104*b* thereof to receive fasteners therethrough into the backrest supports 30*a* and 30*b* to further secure the backrest hoop to the backrest supports.

Referring to FIG. 1*i*, the chair 10 described above can be part of a folding and stacking chair system, indicated generally at 150, comprising a plurality of folding and stacking chairs. The chairs have an unfolded seating position, as shown in FIGS. 1*a-h*, in which the chairs are configured for sitting upon, and a folded and stacked position, as shown in FIG. 1*i*, in which the chairs are folded and stacked together. (The chairs can be stacked horizontally, as shown, or vertically with one atop another.) The front and rear legs can have matching profiles with the rear legs nesting in the profile of the front legs of the same chair in the folded and stacked position. In addition, adjacent stacked chairs 10 and 10' have the front legs 26*b'* of one chair 10' nesting in the profile of the rear legs 34*b* of another chair 10 in the folded and stacked position. Furthermore, the backrest supports 30*b* and 30*b'* of the adjacent stacked chairs are spaced apart in the folded and stacked position. A front edge of the seat 14' of one chair 10' can extend between the backrest supports 30*b* of an adjacent stacked chair 10 in the folded and stacked position.

In addition, the chair can have feet 160 that provide both a slip and scratch resistant surface, and a stacking aid. The feet for both the front and rear legs can be identical or universal; but with opposite orientations. Each foot 160 has a bottom surface 164 to abut to a support surface in the unfolded seating position and oriented at an acute angle with respect to a bottom of the leg. In addition, each foot 160 has a channel 168 oriented transverse to the bottom surface with the channel on the front foot receiving an adjacent stacked leg in the folded and stacked position. An insert portion of the foot can be inserted into an open bottom end of the tubular front and rear legs. The insert portion can be sized to be press fit into the legs. A foot 160' on a front leg 26*b'* of one chair 10' abuts the rear leg 34*b* of the adjacent stacked chair 10. Adjacent stacked chairs are laterally secured by a rear leg 34*b* of one chair 10 received within a channel 168 on a foot 160' of a front leg 26*b'* of another chair 10'.

Furthermore, the chair can have top stops or caps 178 on tops of the rear legs 34*a* and 34*b* that provide an abutment surface between the front and rear legs, support for the front legs, and a stacking aid. The rear legs 34*a* and 34*b* of the frame sides have a tubular configuration with an open top end with a pair of top stops each disposed in a different of the open top ends of the rear legs. The top stop 178 has opposite channels including a support channel 182 receiving the front leg 26*a* of the same chair in the unfolded seating position, and a stacking channel 186 receiving the front leg 26*a'* of an adjacent stacked chair.

The top stop or bottom of the support channel 182 has an unfolded, support abutment surface to abut the front leg 26*a* of the same chair in the unfolded seating position. In addition, the top stop has an inner support fin to abut to an inner surface of the front leg 26*a* of the same chair in the unfolded seating position to resist inward bowing of the front leg. Thus, the inward force on the seat hoop from the mesh pulls on the front legs, which in turn pushes on the inner fin of the rear legs. Furthermore, the top stop has an outer fin forming the support channel 182 along with the inner fin to receive the front leg of the same chair.

The top stop or bottom of the stacking channel 186 has a folded, stacking abutment surface to abut the front leg 26*a'* of an adjacent stacked chair. In addition, the top stop has an outer stacking fin to abut to an outer surface of the front leg 26*a'* of the adjacent stacked chair to resist movement between adjacent stacked chairs. Furthermore, the top stop has an inner fin forming the stacking channel 186 along with the outer fin to receive the front leg of the adjacent stacked chair.

The top stops can have an insert portion for insertion into the open upper end of the rear legs and forming an interference fit. In addition, the top stops can have a rivet hook extending into the rear legs and around a rivet through the rear legs. The top stops can be formed of plastic. The plastic can be flexible to all the rivet hook to flex and snap around the rivet during assembly. The plastic can include a harder plastic body with a softer plastic disposed over the body, such as on the abutment surface or fins to resist injury to pinched fingers and/or to reduce noise.

Adjacent stacked chairs 10 and 10' are separated by a top stop 178 on a rear leg 34*b* of one chair 10 abutting the front leg 26*b'* of another chair 10' and a foot 160' on the front leg 26*b'* of the another chair 10' abutting the rear leg 34*b* of the one chair 10. Separating the front and rear legs of adjacent stacked chairs helps resist damage or marring of the surface finish of the legs and resist noise during stacking and unstacking. In addition, adjacent stacked chairs 10 and 10' are laterally secured by a rear leg 34*b* of one chair 10 received within a channel 168' on a foot 160' of a front leg 26*b'* of another chair 10', and the front leg 26*b'* of the another chair 10' received within a stacking channel 186 on a top stop 178 of the rear leg 34*b* of the one chair 10. The channels or fins thereof help maintain the chairs in the stack and resist relative movement of the chairs with respect to one another. Thus, the top stop and foot of adjacent stacked chairs work together.

When several chairs are stacked and horizontally oriented, a greater portion of the weight or mass of the chairs is located towards the bottom of the chair (or to a lateral side when stacked). This weight keeps the bottom portion of halves of the chairs together when stacked, and keeps the upper portion or halves of the chairs separated from one another, so that the chairs maintain an aligned vertical stack.

The aspects of the chair described above help provide an improved stacking chair; with decreased weight while retaining strength and comfort; while maintaining an affordable and manufacturable chair. The curvilinear profile of the frame and chair legs in the folded configuration and the alignment channels of the top stops and the feet combine to provide a stable and stackable chair. In addition, the mesh stretched between plastic hoops provides comfort and reduces weight while maintaining strength and affordability.

As described above, the seat and the backrest, or the hoops thereof, can be injection molded. The mesh can be secured between the mating hoops and the hoops attached. The seat can be pivotally coupled to the elongated members and rear chair legs, such as with rivets. The backrest can be slid into engagement with the elongated members, and self-locking and/or secured with a fastener.

Referring to FIG. 5, another folding chair 10*b* is shown that is similar in most respects to that described above, and which description is herein incorporated by reference, but demonstrating an open-end front 76*b* of the seat hoop 52*b* facing in a forward or front orientation, and an open-end top 120*b* of the backrest hoop 56*b* facing in a forward or front orientation. The seat and backrest hoops can be used together, as shown, or with the backrest and seat hoops described above. A perimeter of the sheet of mesh corresponding to a rear cross-bar 62 and lateral sides 64*a* and 64*b* is embedded in the rear cross-bar and lateral sides. The sheet of mesh can have a finished edge 80 spanning the open-end front 76*b* of the hoop, as described above. In addition, the mesh at the front of the seat can be turned down or dropped down forming a curve with the finished edge 80 transverse to the mesh of the seat. Similarly, with respect to the backrest hoop, a perimeter of the sheet of mesh corresponding to a bottom cross-bar 112 and lateral sides 104*a* and 104*b* is embedded in the bottom cross-bar and lateral sides. The sheet of mesh or textured plastic can have a finished edge 80 spanning the open-end top 120*b* of the hoop. The arcuate bottom 112 extends between bottom ends of the hoop sides. The bottom arcs rearward with respect to the chair and to a greater degree than any arcing of the top in the rearward direction. The bottom of the backrest forms a deeper arc than a top of the backrest. The sheet of mesh forms a lumbar support near the arcuate bottom of the hoop of the backrest.

Figure 6:
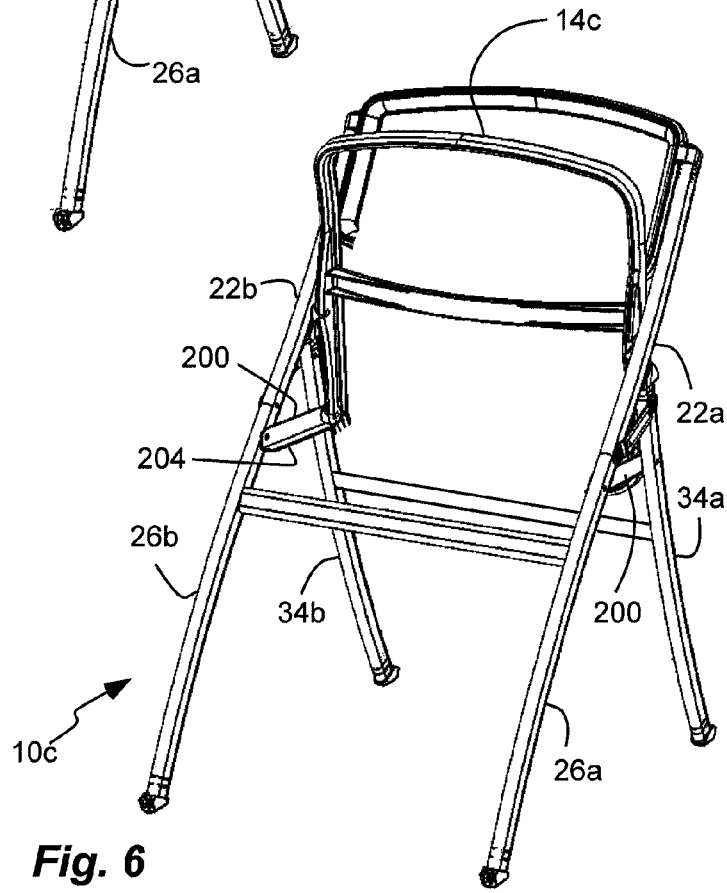
FIG. 6 is a perspective view of another folding chair in accordance with another embodiment of the present invention shown in an unfolded seating position, but with the seat in a folded position, and with mesh of the seat and backrest removed for clarity.

Referring to FIG. 6, another folding chair 10*c* is shown that is similar in most respects to those described above, and which description is herein incorporated by reference, but with a seat 14*c* that pivots with respect to the frame sides and the back rest when the remainder of the chair is still in the unfolded position. Such a chair can be ganged together with other chairs to form a row of chairs for use in arenas and the like with the seats pivoted to a folded position to increase a passage between adjacent rows. The rear of the seat can be pivotally coupled to the rear legs as described above, but not to the front legs as described above. Instead, a pseudo-seat link 200 can be pivotally coupled between the front and rear legs, in place of the seat. Thus, the pseudo-seat link can take the place of the seat in the four-bar linkage and fold with the chair. The chair can rest on a tab 204 extending from the link to support the seat when the seat is in the unfolded position. The flange holds the weight of the user when the user sits on the seat. The link and flange can be formed of metal.

As illustrated in FIGS. 7*a-e*, a stacking chair, indicated generally at 10*d*, which is similar in many respects to those described above, and which description is herein incorporated by reference, but with a stacking configuration. The chair 10*d* has a seat 14*d* and a backrest 18*d* much as described above. The seat 14 and backrest 18 can have a stretched mesh over all-plastic and/or open-end frames or hoops 52*d* and 56*d* to achieve upholstered comfort in a non-upholstered stacking chair. In addition, the chair can use the all-plastic frames with mesh for the seat and the backrest supported by a metal frame sides and legs for a sturdy, strong, and light-weight chair. In addition, the metal frame sides and/or legs can be secured to the seat hoop by a joint where the front and rear legs overlap. The chair, or its components, can be shipped in a flat, knock-down box and can be ready to assemble (RTA). The chair can be easily and quickly assembled by placing the legs in the joint and attaching an outer clamp of the joint and snap fitting the backrest. The chair, or its components, can be provided and assembled without welding and without cross leg supports between the front legs or the rear legs. Furthermore, the seat can have a broadly curved front and upper edge, or waterfall edge, to resist a hard surface against a backside of a user's leg. Furthermore, the final shape of mesh back provides lumbar support. The chair of the present invention provides a comfortable seating experience that can be stacked with other chairs and that can be shipped in a flat, knock-down box and can be ready to assemble (RTA).

The chair 10 can include a frame with opposite frame sides 23*a* and 23*b* that carry the seat 14*d* and backrest 18*d* therebetween. The frame sides can each include an elongated member defining a front leg 27*a* and 27*b* with a lower portion thereof, and a backrest support 31*a* and 31*b* with an upper portion thereof. Thus, the backrest support 31*a* and 31*b* is essentially an extension of the front leg 27*a* and 27*b*. In addition, the opposite side frames can each include a rear leg 35*a* and 35*b*. Thus, the frame sides can each include a pair of tubes with one tube forming the front leg and backrest support and the other tube forming the rear leg (and armrest support in some embodiments). The frame sides 23*a* and 23*b* can be coupled together by the seat 14*d* and backrest 18*d*, without any need for front or rear lower cross members that extend between the front and rear legs respectively nearer a lower end of the legs as in other chairs. Thus, the lower ends of the front and rear legs are free beyond their connection to the seat. The front and rear legs can be rigidly coupled together, and fixed in a spaced-apart relationship with respect to one another. The front and rear legs are inclined outwardly (forwardly and rearwardly) to facilitate stacking with another chair. The front legs (or elongated members) and the rear legs can be separate and discrete components joined together at joints 42*a* and 42*b*, as described in greater detail below. Thus, a respective front and rear leg are joined to the seat at the joint, and joined to the other front and rear leg by the seat. The front and rear legs, and the backrest support, can be formed of metal, such as steel or aluminum, and can be tubular for lighter weight. The cross-sectional shape of the members and chair legs can be elliptical for added strength. In addition, the members can be curvilinear and can have a gradual or shallow stretched s-shaped profile to facilitate stacking. The front and rear legs can have opposite, concave curvature so that they can nest or stack with legs of an adjacent chair. The chair 10 can have an unassembled, ready to assemble, and ready to ship configuration; and an assembled, seating or ready for use configuration. In the unassembled, ready to assemble and ready to ship configuration, the chair or its components can fit in a flat, knock-down box. In the assembled, seating or ready for use configuration, the chair rests on a support surface and a user can sit on the seat, and the chair can be stacked on another chair and stored in less space.

The seat 14*d* and the backrest 18*d* can each have a continuous sheet of flexible and elastic mesh (represented by 45) held taut across and substantially covering the seat and backrest, as described above. Alternatively, the seat 14*d* and the backrest 18*d* can each have a continuous sheet of flexible and elastic patterned open texture plastic (represented by 46) held across and substantially covering the seat and backrest, also as described above. In either case, the sheet of mesh or the sheet of plastic can provide the sole or only support of the user's weight. Thus, each side of the sheet of mesh or the sheet of plastic can be free or open, without other materials or fillers, such as foam or cloth. In addition, the sheet of mesh or the sheet of plastic can define a seating surface and backrest surface directly abutting the user without intervening cushion or material.

Figure 8:
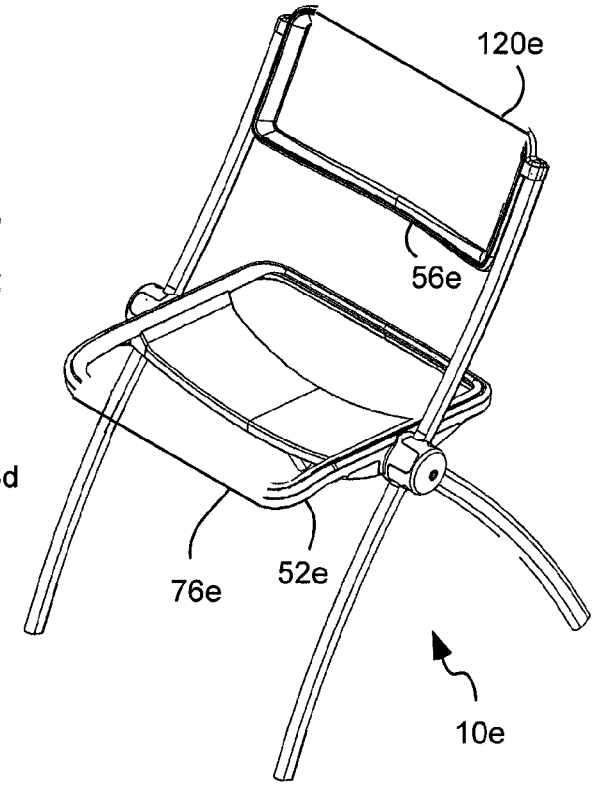
FIG. 8 is a front perspective view of another stacking chair in accordance with another embodiment of the present invention shown with mesh of the seat and backrest removed for clarity.

One or both of the hoops can be open-end hoops, such as an open-end seat hoop 52*d*. An open-end back 76*d* of the seat hoop 52*d* can facing in a rearward or back orientation. Thus, the seat hoop 52 can have the open-end back 76*d*, the front cross-bar 68*d*, and lateral sides 65*a* and 65*b*. Alternatively, an open-end front 76*e* of the seat hoop 52*e* can face in a forward or front orientation, as shown in FIG. 8. The sheet of mesh 45 or textured plastic 46 can have a finished edge 80 spanning the open-end 76*d* of the hoop. The finished edge 80 can be a heavier knit in the knit mesh 45. The heavier knit can be a more dense knit with greater thread count, such as twice the number of threads or strands. In addition, the finished edge 80 can also be thicker, with thicker strands, or overlapping strands, such as two to four strands overlapping. Alternatively, the finished edge 80 can be a heavier and/or thicker plastic edge in the sheet of plastic 46. The plastic edge can be continuous and uninterrupted, without openings. In addition, the mesh 45 at the rear of the seat can be turned down or dropped down forming a curve with the finished edge 80 transverse to the mesh of the seat.

The backrest hoop 56*d* can be an open-end backrest hoop. An open-end bottom 120*d* of the backrest hoop 56*d* can facing in a down or downward orientation. Thus, the backrest hoop 56*d* can have the open-end bottom 120*d*, the top cross-bar 108*d*, and lateral sides 105*a* and 105*b*. Alternatively, an open-end top 120*e* of the backrest hoop 56*e* can face in a forward or front orientation, as shown in FIG. 8. In addition, the mesh 45 at the bottom of the backrest can be turned back or dropped back forming a curve with the finished edge 80 transverse to the mesh of the backrest. As described above, a gap is defined between the finished edge of the seat and the finished edge of the backrest.

In one aspect, only the seat can include the mesh supported by a seat frame. In another aspect, only the backrest can include the mesh supported between the backrest supports of the frame sides or a backrest frame. In another aspect, both the seat and the backrest can include the mesh. Whether one of the seat or the backrest or both include mesh can depend on the needs of the user.

The seat hoop 52*d* can also include a rigid plastic seat-support bar 75 laterally traversing the seat hoop to provide support to the seat hoop and frame sides. As a user sits on the mesh 45 of the seat 14*d*, the mesh pulls inwardly on the seat hoop 52*d*, and thus the frame sides 23*a* and 23*b*; which is resisted by the seat-support bar 75. The bar has an arcuate shape that curves downwardly from the sides to the center and into which the mesh of the seat can deflect when a user sits on the seat. The bar 75 can have a depth (front to back) of approximately ⅓ to ½ the depth of the seat. In addition, a distance from a top of the hoop of the seat to a lowermost top of the seat-support bar is greater than 2 inches to allow the mesh of the seat to deflect downwardly under the weight of a user. The bar 75 can be formed with the hoop 52*d*.

The all-plastic and/or open-end hoops can be formed by injection molding plastic, and may be formed of, or can include, polypropylene or nylon or ABS. In one aspect, the hoops can be formed of nylon and the seat hoop 52 can weigh less than 4 lbs, the backrest hoop 56 can weigh less than 1.125 lbs, and together can weigh less than 5.125 lbs, to reduce the weight of the chair while providing sufficient strength. In another aspect, the hoops can be formed of nylon and the seat hoop can weigh less than 2.75 lbs, the backrest hoop can weigh less than 0.75 lbs, and together can weigh less than 3.5 lbs. In another aspect, the hoops can be formed of polypropylene and the seat hoop can weigh less than 2.75 lbs, the backrest hoop can weigh less than 0.75 lbs, and together can weigh less than 3.5 lbs. In another aspect, the hoops can be formed of polypropylene and the seat hoop can weigh less than 2.3 lbs, the backrest hoop can weigh less than 0.6 lbs, and together can weigh less than 2.9 lbs. The amount or weight of the plastic material of the all-plastic hoops is balance to provide sufficient strength to the frame and the sheet of mesh or plastic, while also reducing the weight of the chair. Such a configuration as described above can support a static load of at least 1250 lbs. In another aspect, it is believed that sufficient strength can be provided by a seat hoop with a weight as low as 1.25 lbs, a backrest hoop with a weight as low as 0.5 lbs, and a combined weight as low as 1.75. The all-plastic hoops are all-plastic in that they do not have any internal or external metal reinforcement members, although the plastic of the hoops can have fillers such as glass fibers. Thus, the seat and/or backrest hoops support both the mesh and the frame, reducing the number of parts and cost of the chair. The mesh 45 can be bonded, such as chemically or adhesively, in a channel 60 in the hoops, such as by melting the material of the mesh and the hoops together, or by chemical reaction, or with adhesive, or the like. Thus, the sheet of mesh can be attached to the hoop without mechanical fasteners, such as staples. (The mesh is represented by 45. Most of the mesh has been removed from the figures for clarity of the chair, seat, backrest and hoops. But the mesh extends across the entire opening of the hoops.)

The mesh 45 of the seat 14*d* and backrest 18*d* held taut in the hoops provide the comfort of an upholstered comfort in a non-upholstered stacking chair; while the hoops can provide the sole, or only, structural support between the frame sides without front and rear lower cross members, or at least above the bottom thereof, or above front and rear lower cross members if so provided. As described above, the hoops can provide the support for both the mesh and the frame sides of the stacking chair. The all-plastic hoop 56*d* of the backrest provides the sole structural support between the backrest supports 31*a* and 31*b* of the frame sides 23*a* and 23*b*. Similarly, the all-plastic hoop 52*d* of the seat provides the sole structural support between the frame sides 23*a* and 23*b* at a middle of the chair or frame sides. Together, the all-plastic hoops 52*d* and 56*d* of the seat and backrest provide the sole structural support between the frame sides 23*a* and 23*b*. The hoops can be directly coupled to the frame sides, without intervening support members. The seat hoop 52*d* can be coupled to the frame sides, or front and rear legs, by a mechanical fastener such as a bolt. The backrest hoop 56*d* can couple to the backrest supports as described above. The hoops can be injection molded nylon with a total weight of less than 4 lbs to provide both light weight for ease of stacking and moving the chairs, and strength to support the taut mesh across the opening and support the frame sides.

Additional details of the stacking chair and clamps is found in U.S. patent application Ser. Nos. 12/612,252 and 12/612,257, which are herein incorporated by reference. The frame sides 23*a* and 23*b*, or front and rear legs 27*a*, 27*b*, 35*a* and 35*b*, can be coupled to the seat 14*d*, or the all-plastic seat hoop 52*d*, at joints 42*a* and 42*b* disposed on opposite sides of the chair. At each joint, one of the legs, such as the rear leg 35*a*, can be outside of the other leg, such as the front leg 27*a*, with respect to the seat 14*d* or seat hoop 52*d*. In addition, at each joint, the legs overlap at an overlap, such as with the rear leg 35*a* overlapping the front leg 27*a*. The joint 42*a* couples the legs 27*a* and 35*a* to the seat 14*d* or seat hoop 52*d* at the overlap. The joints 42*a* and 42*b* include an inner clamps 84*a* and 84*b* coupled to the seat 14*d* or seat hoop 52*d*, and an outer clamps 88*a* and 88*b* coupled to the inner clamps 84*a* and 84*b*, with the front legs 27*a* and 27*b* and the rear legs 35*a* and 35*b* clamped between the inner and outer clamps at the overlap. The inner clamps 84*a* and 84*b* can be integrally formed with the seat as a single integral, monolithic member of continuous material, such as plastic. In addition, the inner clamps 84*a* and 84*b* can be formed with a pair of lobes that can extend downwardly from lateral sides of the seat hoop 52*d*. The lobes can be formed by plastic along with the chair hoop and inner clamps. The outer clamps 88*a* and 88*b* can be formed of metal for strength.

Each of the inner and outer clamps 84*a* and 84*b* can have inner and outer overlapping bores formed between the inner and outer clamps. The bores receive the front and rear legs, and can have cross-sectional shapes to match the cross-sectional shapes of the legs, such as oval. The non-circular shape of the bores and the legs help resist twisting of the legs within the bores. For example, the front leg 27*a* can be disposed in the inner bore, while the rear leg 35*a* is disposed in the outer bore. The inner and outer bores can be oriented transverse to one another, like the legs. The inner bore can extend through the joint or inner and outer clamps with the front leg 27*a* or elongated member (with front leg 27*a* backrest support 31*a*) extending therethrough. The outer bore can be capped or enclosed at the upper end with the rear leg extending into the bore and to the cap, but with the cap covering the upper end of the rear leg. Alternatively, the rear leg can extend through the outer bore to an arm rest as described below and shown in FIG. 9.

The inner and outer bores can be formed by channels in the inner and outer clamps. The channels can be formed between posts of the inner and outer clamps which extend towards one another. The joint is formed by the inner and outer clamps, and the front and rear legs, and is substantially solid with substantially no exposed openings. The solid configuration of the joint resists snagging with clothing and resists pinching of the legs or fingers of a seated person.

Figure 7A:
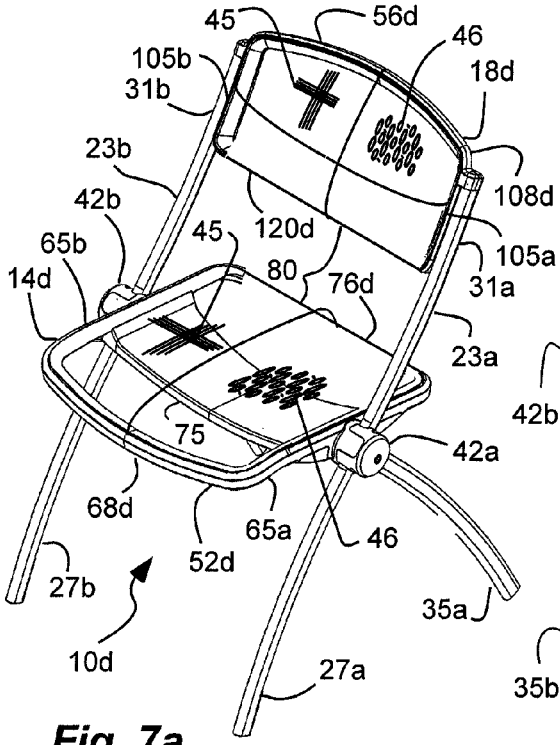
FIG. 7*a* is a front perspective view of a stacking chair in accordance with another embodiment of the present invention shown with mesh of the seat and backrest mostly removed for clarity.
Figure 7B:
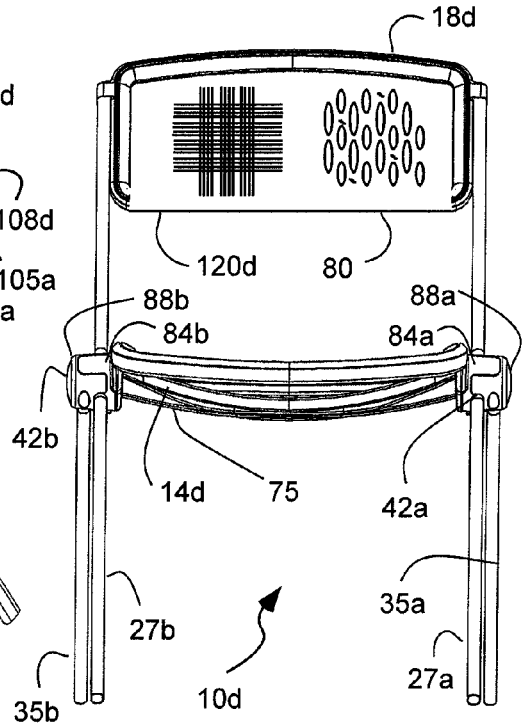
FIG. 7*b* is a front view of the stacking chair of FIG. 7*a;*
Figure 7C:
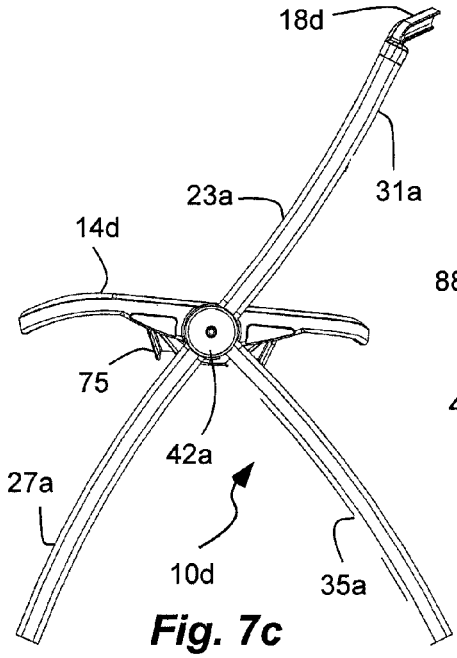
FIG. 7*c* is a side view of the stacking chair of FIG. 7*a;*
Figure 7D:
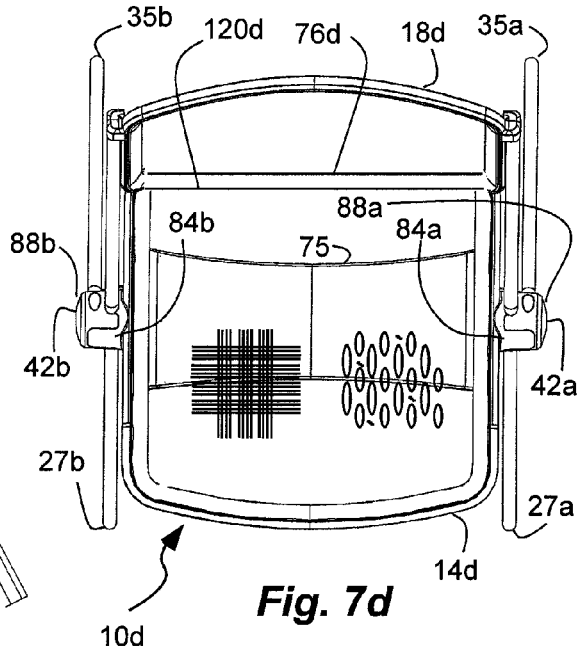
FIG. 7*d* is a top view of the stacking chair of FIG. 7*a;*
Figure 7E:
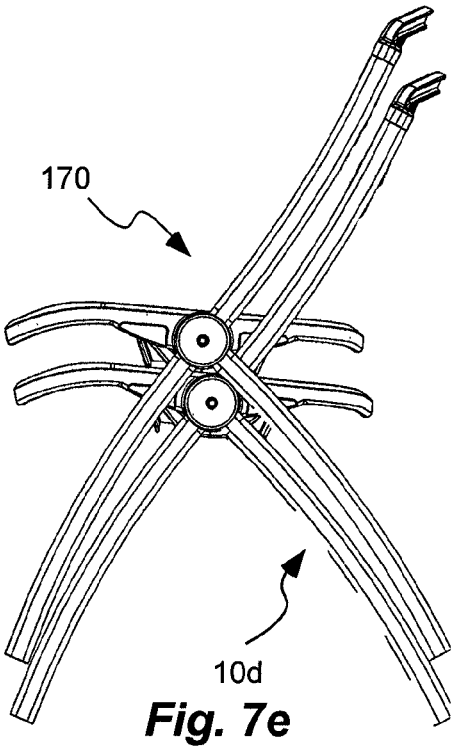
FIG. 7*e* is a side view of the stacking chair of FIG. 7*a* show stacked with an adjacent chair.

Referring to FIG. 7*e*, the chair 10*d* described above can be part of a stacking chair system, indicated generally at 170, comprising a plurality of stacking chairs. The chairs have an unstacked seating position, in which the chairs are configured for sitting upon, and a stacked position, in which the chairs are stacked together. The joints 42*a* and 42*b* can be configured to facilitate the stacking of the chairs. The joints or the inner clamps 84*a* and 84*b* can include a tab or hook extending from the joint or inner clamp to engage a leg or a frame, such as the front leg 27*a* or upper portion of the elongated member, of a lower stacked chair. Thus, a channel is formed between the tab and the rear leg that receives the front leg or upper portion of the elongated member of the lower chair to resist movement between the stacked chairs. In addition, a dimple can be formed in the joint or outer clamp 88*a* to receive a leg, such as the rear leg 35*a*, of an upper stacked chair. Similarly, the dimple resists movement between the stacked chairs. Therefore, the joints are configured to facilitate stacking.

Referring to FIG. 8, another chair 10*e* is shown that is similar in most respects to those described above, and which description is herein incorporated by reference, but demonstrating an open-end front 76*e* of the seat hoop 52*e* facing in a forward or front orientation, and an open-end top 120*e* of the backrest hoop 56*e* facing in a forward or front orientation. The seat and backrest hoops can be used together, as shown, or with the backrest and seat hoops described above.

Figure 9:
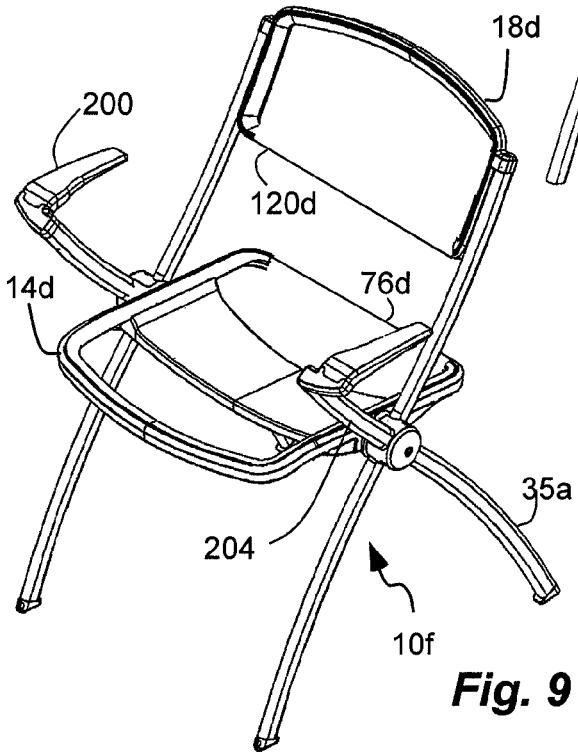
FIG. 9 is a front perspective view of another stacking chair in accordance with another embodiment of the present invention shown with mesh of the seat and backrest removed for clarity.
Figure 10A:
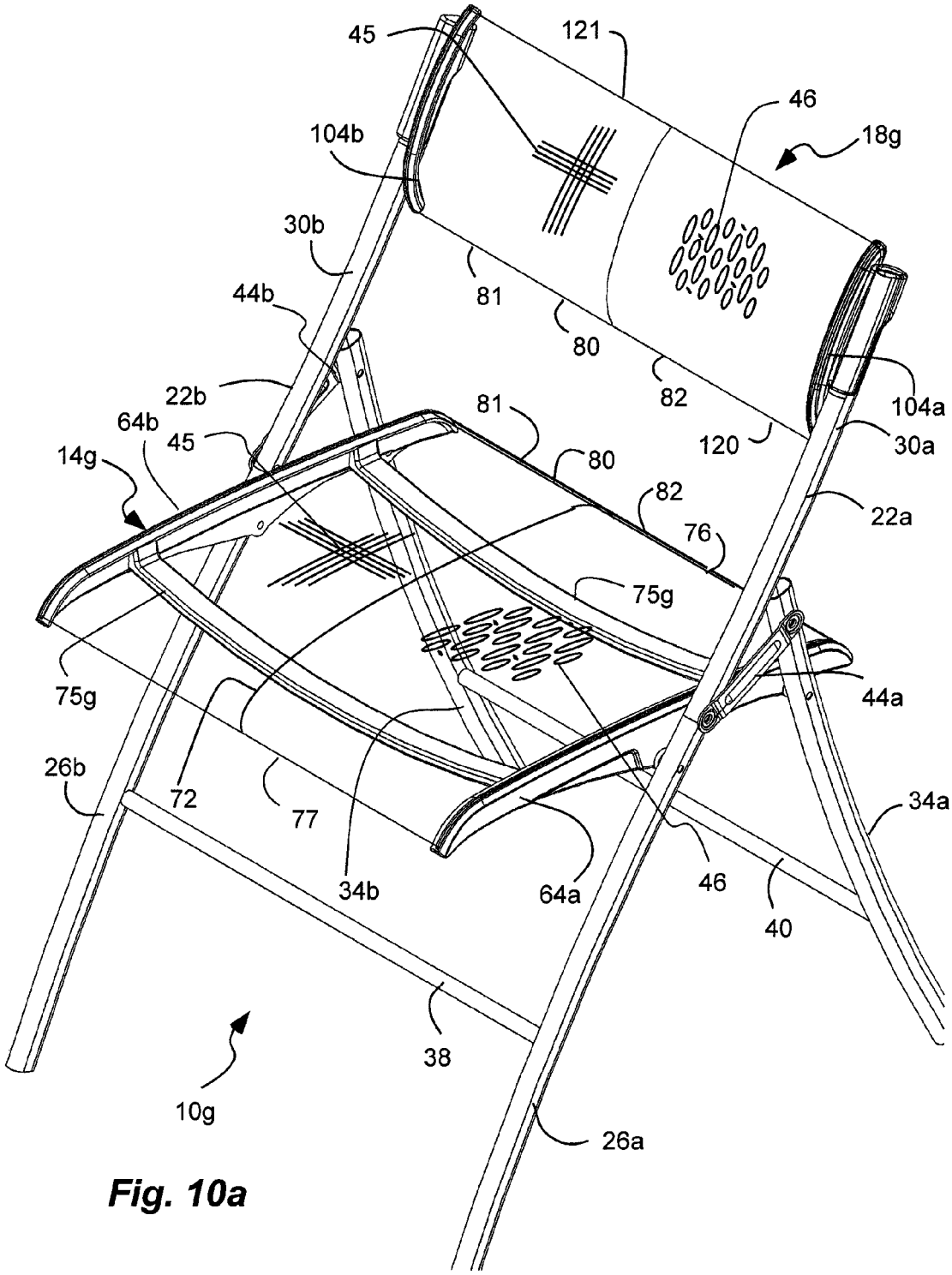
FIG. 10*a* is a front perspective view of another folding chair in accordance with another embodiment of the present invention shown in an unfolded seating position and with mesh of the seat and backrest mostly removed for clarity.
Figure 10B:
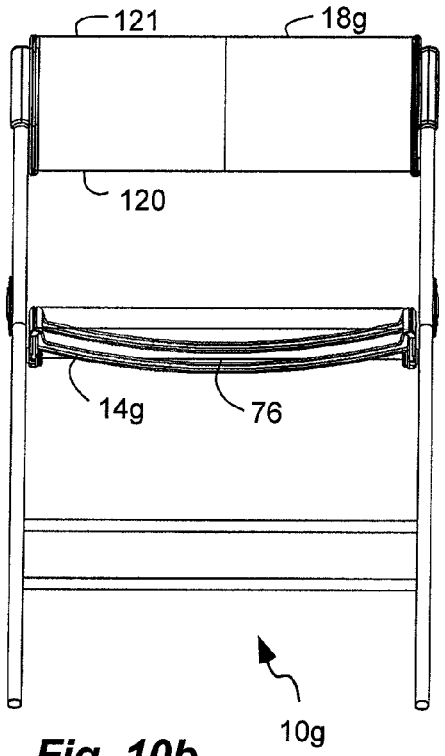
FIG. 10*b* is a front view of the folding chair of FIG. 10*a;*
Figure 10C:
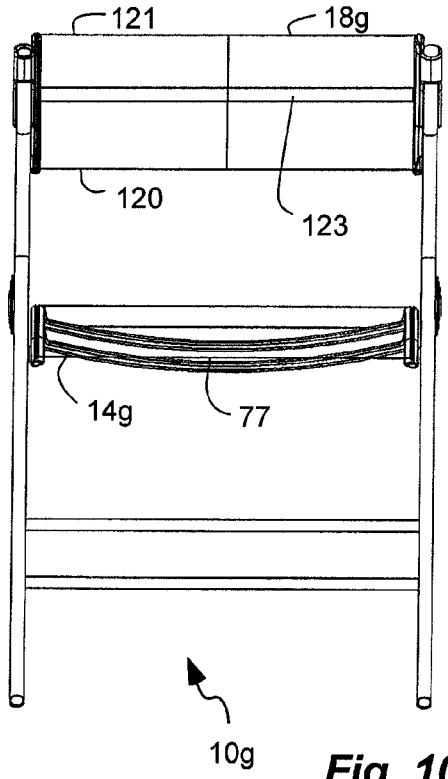
FIG. 10*c* is a back view of the folding chair of FIG. 10*a;*
Figure 10D:
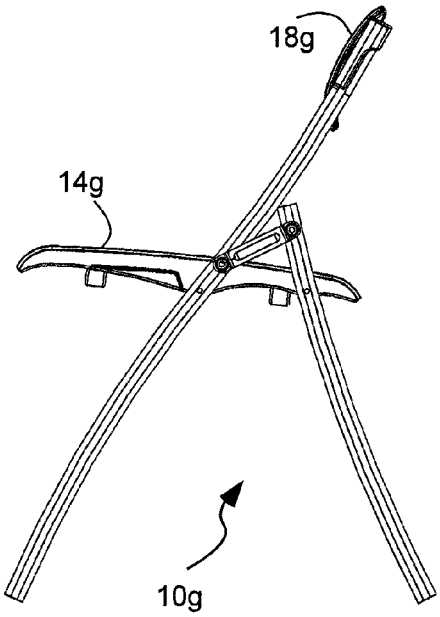
FIG. 10*d* is a side view of the folding chair of FIG. 10*a;*
Figure 10E:
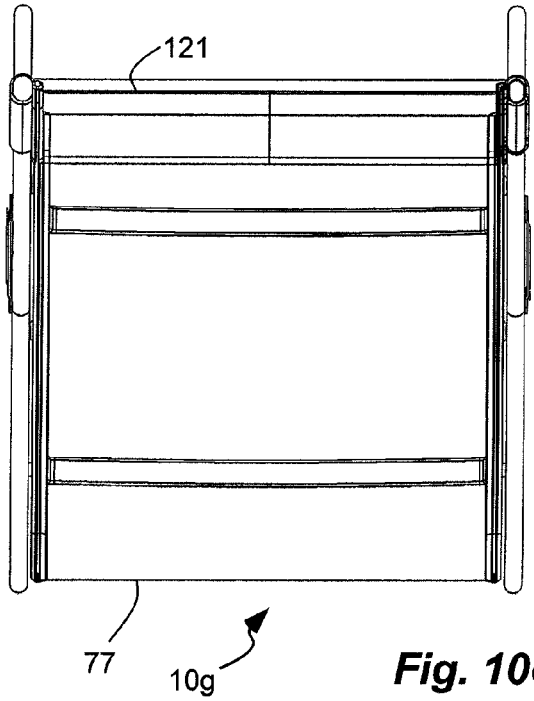
FIG. 10*e* is a top view of the folding chair of FIG. 10*a;*
Figure 10F:
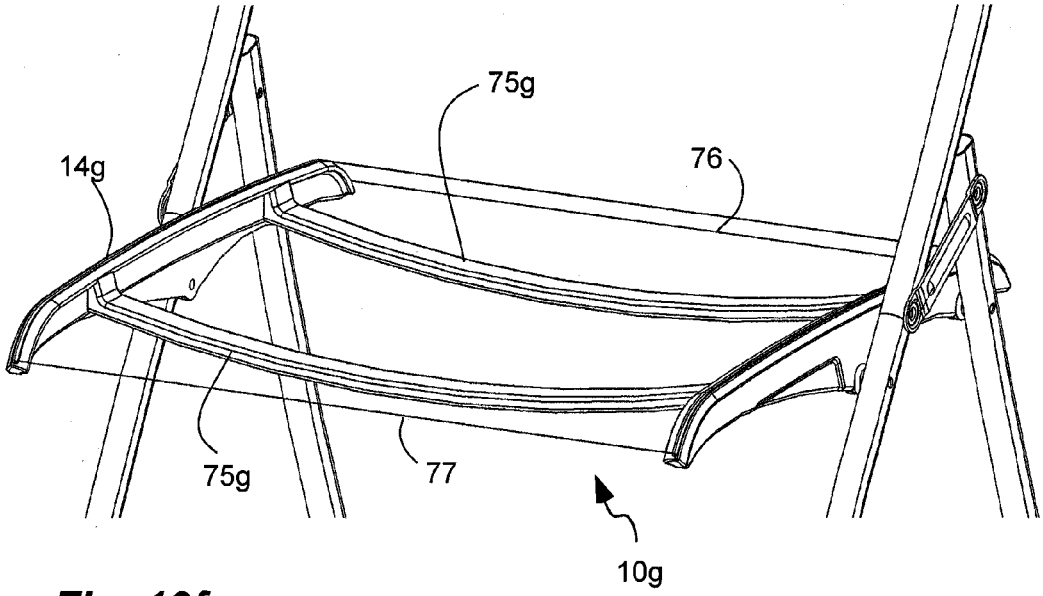
FIG. 10*f* is a partial detail perspective view of a seat of the folding chair of FIG. 10*a*.
Figure 10G:
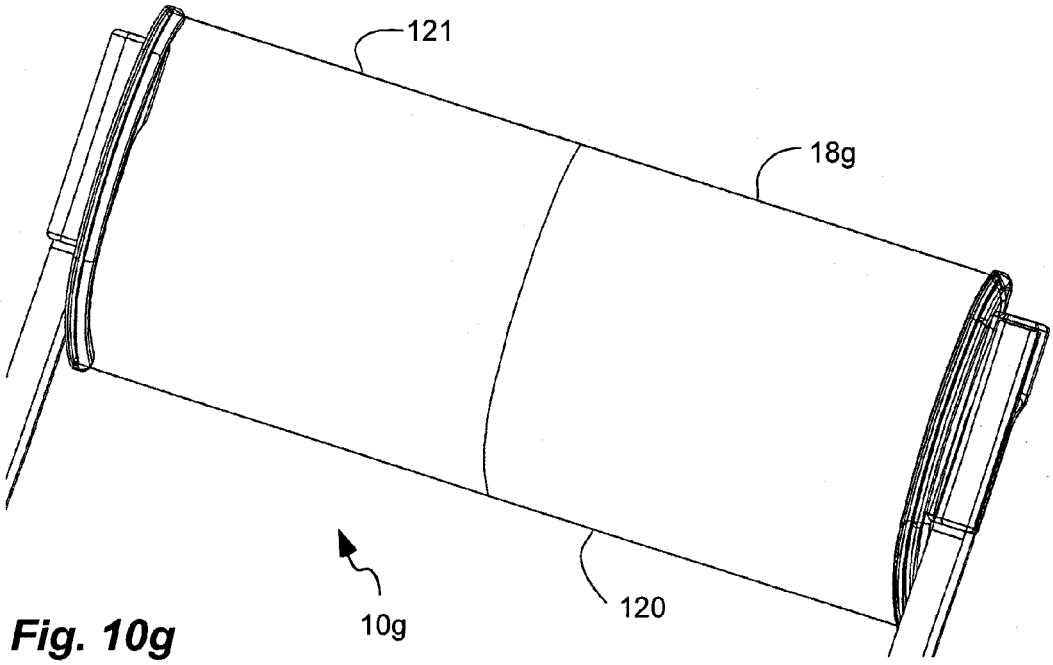
FIG. 10*g* is a partial detail perspective view of a backrest of the folding chair of FIG. 10*a.*

Referring to FIG. 9, another chair 10*f* is shown that is similar in most respects to those described above, and which description is herein incorporated by reference, but further including armrests 200. An upper portion or extension 204 of the rear legs 35*a* and 35*b* can extend beyond the joint. The armrests 200 can be disposed on the upper portions.

The chair can have feet that provide both a slip and scratch resistant surface, and a stacking aid. The feet for both the front and rear legs can be identical or universal; but with opposite orientations. Each foot has a bottom surface to abut to a support surface in the seating position. In addition, each foot can have a channel for receiving an adjacent stacked leg in the stacked position. An insert portion of the foot can be inserted into an open bottom end of the tubular front and rear legs. The insert portion can be sized to be press fit into the legs. Alternatively, the chair legs can be provided with casters so that the chair can roll on a support surface.

The aspects of the chair described herein help provide an improved stacking chair; with decreased weight while retaining strength and comfort; while maintaining an affordable and manufacturable chair. In addition, the mesh stretched between plastic hoops provides comfort and reduces weight while maintaining strength and affordability.

The chair or its components can be shipped in a flat, knock-down box and can be ready to assemble (RTA). The components of the chair include the seat, the backrest, the front legs (and backrest supports), the rear legs, the outer clamps of the joints, and a pair of bolts. All of the components can be provided separately in a box with a thickness t less than 4 inches. The thinness of the box allows for greater shipping efficiency. The chair can be easily and quickly assembled by placing the legs in the joint and attaching an outer clamp of the joint and snap fitting the backrest. The front leg can be placed in the channel of the inner clamp of the seat; a rear leg can be place over the front leg and in the outer channel of the outer clamp; and a bolt inserted through the holes. This process can be repeated for the other side of the chair. The backrest can be snap fit into the backrest support of the front legs. Thus, the chair can be assembled without welding and without cross leg supports between the front legs or the rear legs.

Referring to FIGS. 10*a-g*, another chair 10*g* is shown that is similar in most respects to those described above, and which description is herein incorporated by reference, but with a seat hoop that is open in the front and the back, and a backrest hoops that is open on the top and the bottom. The seat and backrest have a sheet of mesh or plastic held between parallel sides of the seat and backrest. The seat 14*g* can have a pair of parallel seat sides 64*a* and 64*b* each coupled to a different one of the frame sides 22*a* and 22*b*. The seat or seat frame can have an open-end back 76 and an open-end front 77. A finished edge of the mesh can extend across both the front and the back. One or more seat cross-bars 75*g* can extend between the pair of parallel seat sides. Similarly, the backrest can have a pair of parallel backrest sides 104*a* and 104*b* each coupled to a different one of the backrest supports 30*a* and 30*b* of the frame sides. The backrest or backrest frame can have an open-end bottom 120 and an open-end top 121. A backrest cross-bar 123 can extend between the pair of parallel backrest sides. Alternatively, the backrest can be free of cross-bars or backrest frame components that extend between the sides.

Although the chairs above have been described as having a sheet of mesh or plastic embedded in the plastic of a hoop, it will be appreciated that other methods or fastening systems may be used. For example, the sheet of mesh or plastic may be stretched between a pair of mating annular hoops, including a bottom (outer) hoop and a top (inner) hoop. The hoops can match or mate together to sandwich the mesh material between the hoops. For example, the mesh can extend over an outer perimeter of the inner hoop and into an interface between the inner and outer hoops.

Although one frame or folding configuration has been described above and shown in the drawings, it will be appreciated that other frame and folding configurations can be used with the mesh seat and/or mesh backrest of the present invention.

In addition, the chairs described above can be ganged together to form a ganged chair system.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A chair, comprising:

a) a seat and a backrest carried between opposite frame sides each with a backrest support, a front leg and a rear leg;

b) one or both of the seat and the backrest having a continuous sheet of flexible and elastic knitted mesh or patterned open texture plastic held across and substantially covering an opening in an open-end hoop coupled between the frame sides;

c) an open-end of the hoop facing in a front or a back orientation for the seat or a top or a bottom orientation for the backrest, with sides of the hoop attached to the frame sides;

d) the sheet of mesh or textured plastic having a finished edge spanning the open-end of the hoop;

e) a front leg support extending between front legs;

f) a rear leg support extending between rear legs;

g) both the front and rear leg supports being within five inches of where the seat attaches to the frame sides; and h) only four cross-bars between the frame sides including the front and rear leg supports, a front of a seat hoop and a top of a backrest hoop.

2. A chair in accordance with claim 1, wherein one or both of the seat and the backrest have the continuous sheet of flexible and elastic knitted mesh; and wherein the finished edge has a heavier knit.

3. A chair in accordance with claim 1, wherein the open-end hoop is an open-back seat hoop with the open-end of the seat hoop facing rearwardly.

4. A chair in accordance with claim 1, wherein the open-end hoop is an open-bottom backrest hoop with the open-end of the backrest hoop faces downwardly.

5. A chair in accordance with claim 1, wherein:

the open-end hoop is an open-back seat hoop with the open-end of the seat hoop facing rearwardly;

the open-end hoop is an open-bottom backrest hoop with the open-end of the backrest hoop faces downwardly; and a gap is formed between the seat hoop and the backrest hoop.

6. A chair in accordance with claim 1, wherein the chair is a stacking chair, and further comprising:

the front and rear legs fixed in a spaced apart relationship from one another, the front and rear legs being inclined outwardly to facilitate stacking with another chair.

7. A chair in accordance with claim 1, wherein the chair is a folding chair, and further comprising:

the front and rear legs having an unfolded seating position in which the seat pivots to extend from the frame sides and bottoms of the front and rear legs move apart, and a folded position in which the seat pivots toward the frame sides and the front and rear legs move together.

8. A chair in accordance with claim 1, wherein the sheet curves at the open-end of the hoop; and wherein the finished edge is oriented transverse to the hoop.

9. A chair, comprising:

a) a seat and a backrest carried between opposite frame sides each with a backrest support, a front leg and a rear leg;

b) the seat having a continuous sheet of flexible and elastic knitted mesh held taut across and substantially covering an opening in an all-plastic, open-end seat hoop, the seat hoop coupled between the frame sides;

c) the seat hoop having an open-end back, a front cross-bar and lateral sides attached to the frame sides, with a corresponding perimeter of the sheet of mesh embedded in the front cross-bar and lateral sides, and with a finished edge of the sheet of mesh spanning the open-end back, the finished edge having a heavier knit;

d) the backrest having a continuous sheet of flexible and elastic knitted mesh held taut across and substantially covering an opening in an all-plastic, open-end backrest hoop, the backrest hoop coupled between the backrest supports of the frame sides;

e) the backrest hoop having an open-end bottom, a top cross-bar and lateral sides attached to the backrest supports of the frame sides, with a corresponding perimeter of the sheet of mesh embedded in the top cross-bar and lateral sides, and with a finished edge of the sheet of mesh spanning the open-end bottom, the finished edge having a heavier knit;

f) a gap between the finished edge of the seat and the finished edge of the backrest;

g) a front leg support extending between front legs;

h) a rear leg support extending between rear legs;

i) both the front and rear leg supports being within five inches of where the seat attaches to the frame sides; and j) only four cross-bars between frame sides including the front and rear leg supports, the front cross-bar of the seat hoop and the top cross-bar of the backrest hoop.

10. A chair in accordance with claim 9, wherein the chair is a stacking chair, and further comprising:

the front and rear legs fixed in a spaced apart relationship from one another, the front and rear legs being inclined outwardly to facilitate stacking with another chair.

11. A chair in accordance with claim 9, wherein the chair is a folding chair, and further comprising:

the front and rear legs having an unfolded seating position in which the seat pivots to extend from the frame sides and bottoms of the front and rear legs move apart, and a folded position in which the seat pivots toward the frame sides and the front and rear legs move together.

12. A chair, comprising:

a) a seat and a backrest carried between opposite frame sides each with a backrest support, a front leg and a rear leg;

b) the seat having a continuous sheet of flexible and elastic knitted mesh held taut across and substantially covering an opening in an all-plastic, open-end seat hoop, the seat hoop coupled between the frame sides;

c) the seat hoop having an open-end back, a front cross-bar and lateral sides attached to the frame sides, with a corresponding perimeter of the sheet of mesh embedded in the front cross-bar and lateral sides, and with a finished edge of the sheet of mesh spanning the open-end back, the finished edge having a heavier knit;

d) the backrest having a continuous sheet of flexible and elastic knitted mesh held taut across and substantially covering an opening in an all-plastic, open-end backrest hoop, the backrest hoop coupled between the backrest supports of the frame sides;

e) the backrest hoop having an open-end bottom, a top cross-bar and lateral sides attached to the backrest supports of the frame sides, with a corresponding perimeter of the sheet of mesh embedded in the top cross-bar and lateral sides, and with a finished edge of the sheet of mesh spanning the open-end bottom, the finished edge having a heavier knit;

f) a gap between the finished edge of the seat and the finished edge of the backrest;

g) a front leg support extending between front legs and a rear leg support extending between rear legs, both the front and rear leg supports being within five inches of where the seat attaches to the frame sides; and h) only four cross-bars between frame sides including the front and rear leg supports, the front of the seat hoop and the top of the backrest hoop.

13. A chair in accordance with claim 12, wherein the chair is a stacking chair, and further comprising:

the front and rear legs fixed in a spaced apart relationship from one another, the front and rear legs being inclined outwardly to facilitate stacking with another chair.

14. A chair in accordance with claim 12, wherein the chair is a folding chair, and further comprising:

the front and rear legs having an unfolded seating position in which the seat pivots to extend from the frame sides and bottoms of the front and rear legs move apart, and a folded position in which the seat pivots toward the frame sides and the front and rear legs move together.

15. A chair, comprising:

a) a seat and a backrest carried between opposite frame sides each with a backrest support, a front leg and a rear leg;

b) the seat having a continuous sheet of flexible and elastic knitted mesh held taut across and substantially covering a space between a pair of parallel seat sides each coupled to a different one of the frame sides;

c) at least one open seat end defined by the pair of parallel seat sides with the sheet of mesh having a finished edge extending across the open seat end;

d) a seat cross bar extending between the pair of parallel seat sides;

e) the backrest having a continuous sheet of flexible and elastic knitted mesh held taut across and substantially covering a space between a pair of parallel backrest sides each coupled to a different one of the backrest supports of the frame sides;

f) at least one open backrest end defined by the pair of parallel backrest sides with the sheet of mesh having a finished edge extending across the open backrest end;

g) a backrest cross bar extending between the pair of parallel backrest sides;

h) a front leg support extending between front legs;

i) a rear leg support extending between rear legs;

j) both the front and rear leg supports being within five inches of where the seat attaches to the frame sides; and k) only four cross-bars between the frame sides including the front and rear leg supports, a front of a seat hoop and a top of a backrest hoop.

16. A chair in accordance with claim 15, wherein the chair is a stacking chair, and further comprising:

the front and rear legs fixed in a spaced apart relationship from one another, the front and rear legs being inclined outwardly to facilitate stacking with another chair.

17. A chair in accordance with claim 15, wherein the chair is a folding chair, and further comprising:

the front and rear legs having an unfolded seating position in which the seat pivots to extend from the frame sides and bottoms of the front and rear legs move apart, and a folded position in which the seat pivots toward the frame sides and the front and rear legs move together.

18. A chair in accordance with claim 15, wherein the sheet of mesh curves at the open seat end of the seat; and wherein the finished edge is oriented transverse to the seat.

* * * * *